US009138373B2

(12) United States Patent
Caropelo et al.

(10) Patent No.: US 9,138,373 B2
(45) Date of Patent: Sep. 22, 2015

(54) MASSAGE DEVICE

(71) Applicants: Peter Caropelo, San Francisco, CA (US); John Por, Moraga, CA (US); Ethan Imboden, San Francisco, CA (US)

(72) Inventors: Peter Caropelo, San Francisco, CA (US); John Por, Moraga, CA (US); Ethan Imboden, San Francisco, CA (US)

(73) Assignee: JJ Aquisition, LLC, San Francisco, CA (US)

( * ) Notice: Subject to any disclaimer, the term of this patent is extended or adjusted under 35 U.S.C. 154(b) by 0 days.

(21) Appl. No.: 14/613,200

(22) Filed: Feb. 3, 2015

(65) Prior Publication Data

US 2015/0164738 A1 Jun. 18, 2015

Related U.S. Application Data

(63) Continuation-in-part of application No. 14/474,256, filed on Sep. 1, 2014, now abandoned, which is a continuation of application No. 12/868,498, filed on Aug. 25, 2010, now Pat. No. 8,821,421.

(60) Provisional application No. 62/090,724, filed on Dec. 11, 2014, provisional application No. 61/237,186, filed on Aug. 26, 2009.

(51) Int. Cl.
*A61H 1/00* (2006.01)
*A61H 23/02* (2006.01)

(52) U.S. Cl.
CPC ..... *A61H 23/02* (2013.01); *A61H 2203/02* (2013.01); *A61H 2205/087* (2013.01)

(58) Field of Classification Search
CPC ..... A61H 19/00; A61H 19/30; A61H 19/32; A61H 19/34; A61H 19/40; A61H 19/44; A61H 19/50; A61H 21/00; A61H 23/00; A61H 23/02; A61H 23/0254; A61H 23/0263
USPC ..... 600/38
See application file for complete search history.

(56) References Cited

U.S. PATENT DOCUMENTS

| | | | | |
|---|---|---|---|---|
| 2011/0034837 | A1* | 2/2011 | Lee | 601/46 |
| 2012/0016292 | A1* | 1/2012 | Goldberg et al. | 604/22 |
| 2012/0184884 | A1* | 7/2012 | Dyer et al. | 601/46 |
| 2012/0197072 | A1* | 8/2012 | Cordle | 600/38 |
| 2014/0316310 | A1* | 10/2014 | Ackermann et al. | 601/46 |
| 2014/0323929 | A1* | 10/2014 | Iurchenko | 601/46 |

* cited by examiner

*Primary Examiner* — Justine Yu
*Assistant Examiner* — Kathrynn Reilly
(74) *Attorney, Agent, or Firm* — Manuel de la Cerra

(57) ABSTRACT

A massage device, methods and apparatus are disclosed. Embodiments of a massage device are provided that include a first end configured to be held and manipulated by the hand of a user and a second end configured for application to a portion of the human body. The device firth includes a flexible portion connecting the first end to the second end. The flexible portion contains a source of vibrational motion and has a rigidity of an amount sufficient to transmit the vibrational motion from the source to the second end of the device. The second end may be constructed of a flexible material that allows the material to flutter and magnify the vibrational motion.

19 Claims, 22 Drawing Sheets

MASSAGE DEVICE

1.0 CROSS-REFERENCE TO RELATED APPLICATIONS

The present application claims priority to and is a non-provisional application of U.S. Patent Application No. 62/090,724, filed on Dec. 11, 2014. The present application is also a continuation-in-part of U.S. patent application Ser. No. 14/474,256, filed on Sep. 1, 2014, which is a continuation of U.S. patent application Ser. No. 12/868,498 filed on Aug. 25, 2010, now U.S. Pat. No. 8,821,421 which claims the benefit of U.S. Provisional Patent Application No. 61/237,186, filed Aug. 26, 2009. The present application claims priority to all of the above applications, all of which are incorporated herein by reference in their entireties.

2.0 FEDERALLY SPONSORED RESEARCH OR DEVELOPMENT

None.

3.0 TECHNICAL FIELD

The present invention relates to personal massagers.

4.0 BACKGROUND

Personal massagers typically include vibrating mechanisms contained within a device that a user applies to her or his body. To vary the amount of vibration a user experiences, the user must either use a variety of devices, adjust the speed of vibration of the vibrating mechanism, or attempt to modulate the pressure which the user uses to apply the device to his or her body. The inventors are aware of no devices capable of simultaneously applying to the same area on a user's body vibrations of varied strength and movement. The inventors are likewise aware of no personal massagers capable of effectively providing a light fluttering sensation to a user, or a light fluttering sensation in combination with a strong vibrating sensation in the same area of the user's body. For these and many other reasons, there is much room for improvement in the design of personal massagers.

5.0 SUMMARY

The present invention elegantly improves over the prior art and provides numerous other novel features, as will be apparent to persons of skill in the art. By way of example and not limitation, provided in various example embodiments is a massager comprising means for simultaneously applying to an area of a user's body vibrations of different strengths and movements, comprising: a body that extends longitudinally from a first end to a second end; means for causing the second end to vibrate; the second end comprising wing means for amplifying the movement of the means for causing the second end to vibrate; and the second end further comprising, between the wing means a central means for vibrating with the movement of the means for causing the second end to vibrate, without amplifying the movement of the means for causing the second end to vibrate.

For example, provided in various example embodiments is a massager capable of simultaneously applying to an area of a user's body vibrations of different strengths and movements, comprising: a body that extends longitudinally from a first end to a second end; an electrically-powered vibrating element in vibratory communication with the second end; the second end comprising two opposing and spaced-apart flexibly-compliant wings non-rigidly attached with and extending longitudinally away from the body, each of the wings tapering from a thicker base to a thinner distal end that is adapted to flutter by amplifying the movement of the electrically-powered vibrating element; and the second end further comprising a central end portion located between the wings and adapted to vibrate with the movement of the electrically-powered vibrating element without amplifying the movement of the electrically-powered vibrating element. Various example embodiments may further comprise the second end having a smooth outer surface adapted to comfortably contact and move across a user's body. Various example embodiments may further comprise the wings being part of a stretchable member adapted to be attached with the body by being stretched over at least a portion of the body. Various example embodiments may further comprise the body containing a motor unit and a control housing connected with a flexible substructure. Various example embodiments may further comprise the control housing comprising a printed circuit board that includes buttons adapted to control the electrically-powered vibrating element. Various example embodiments may further comprise a flexible cover over first end and the buttons that is adapted to deform and engage the buttons when a user pushes on corresponding locations on the flexible cover. Various example embodiments may further comprise the first end sized and shaped for a user to grasp during use of the massager, with a substantially smooth and substantially continuous rounded outer surface. Various example embodiments may further comprise the first end comprising controls and charging contacts, and the substantially smooth and substantially continuous rounded outer surface is smooth and continuous with the exception of the controls and the charging contacts. Various example embodiments may further comprise the massager adapted to be completely submersed in water without being damaged. Various example embodiments may further comprise a selectively permeable membrane in the outer surface of the body adapted to allow communication of air but not water therethrough. Various example embodiments may further comprise a flexible mid-section between the first end and the second end. Various example embodiments may further comprise the body varying in cross-sectional size as it extends longitudinally from the first end to the second end. Various example embodiments may further comprise a charging base adapted to hold the massager in a vertically upright position and charge the massager when the massager is placed in the charging base so that only the first end of the massager touches the charging base. Various example embodiments may further comprise the outer surface of the first end of the massager comprising compliant silicone or thermoplastic elastomer, and a portion of the charging base that contacts the first end of the massager comprises polished polycarbonate or acrylonitrile butadiene styrene. Various example embodiments may further comprise two electrically-powered vibrating elements in vibratory communication with the second end, a first one of said electrically-powered vibrating elements located proximate a first one of said wings, and a second one of said electrically-powered vibrating elements located proximate a second one of said wings. Various example embodiments may further comprise the central end portion comprising a convex domed surface. Various example embodiments may further comprise the central end portion in substantially rigid connection with the electrically-powered vibrating element. Various example embodiments may further comprise the second end portion comprising a concave curved surface. Numerous additional features and benefits are provided as set forth herein.

6.0 BRIEF DESCRIPTION OF THE DRAWINGS

Various aspects of certain example embodiments can be better understood with reference to the following figures. The components shown in the figures are not necessarily to scale, emphasis instead being placed on clearly illustrating example aspects and features. In the figures, like reference numerals designate corresponding parts throughout the different views and embodiments. Certain components and details may be omitted from the figures to improve clarity.

7.0 DETAILED DESCRIPTION OF EXAMPLE EMBODIMENTS

Figure 1:
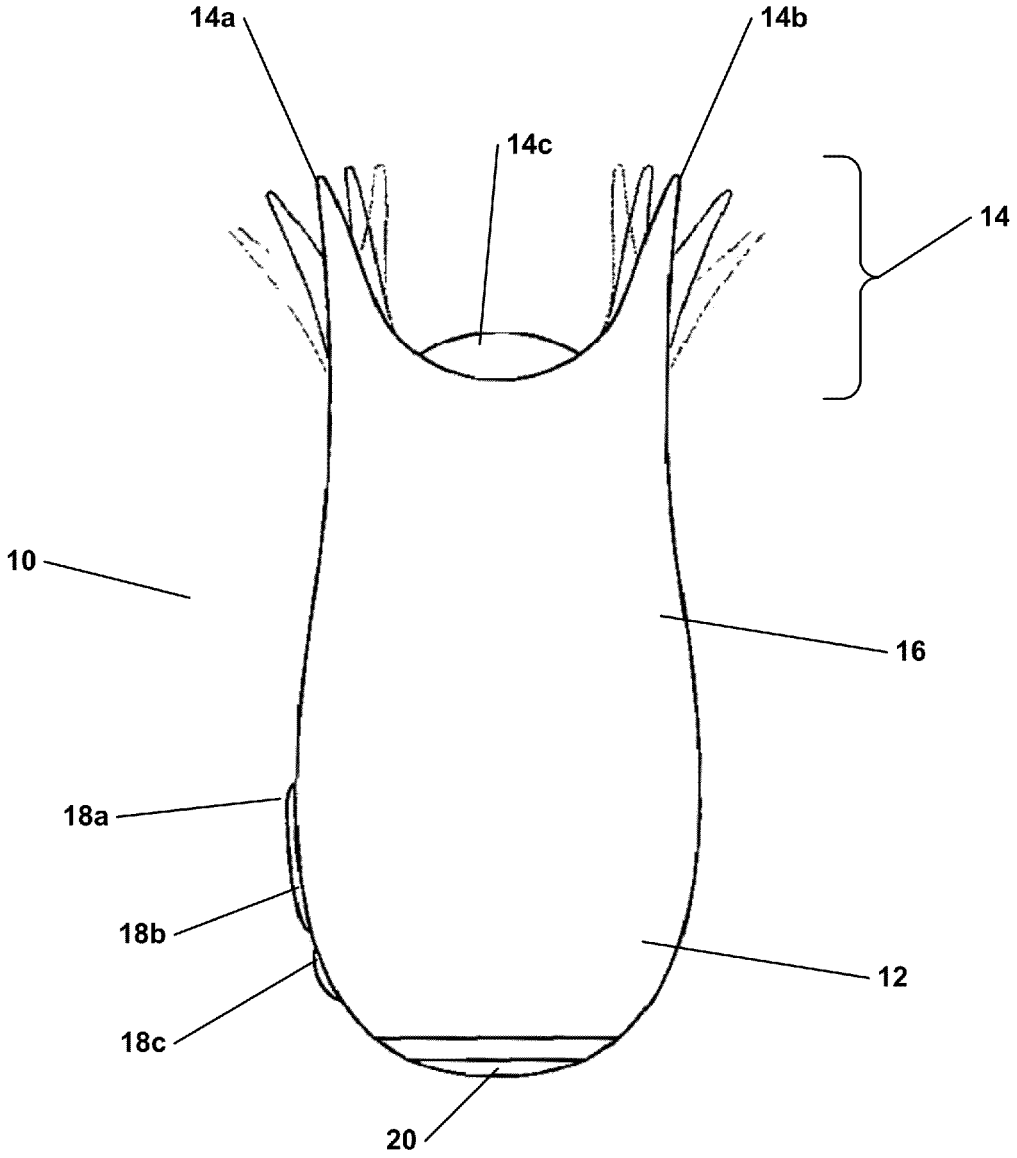
FIG. 1 is a front perspective view of a massager according to a first embodiment of the present invention.
Figures 2A, 2B:
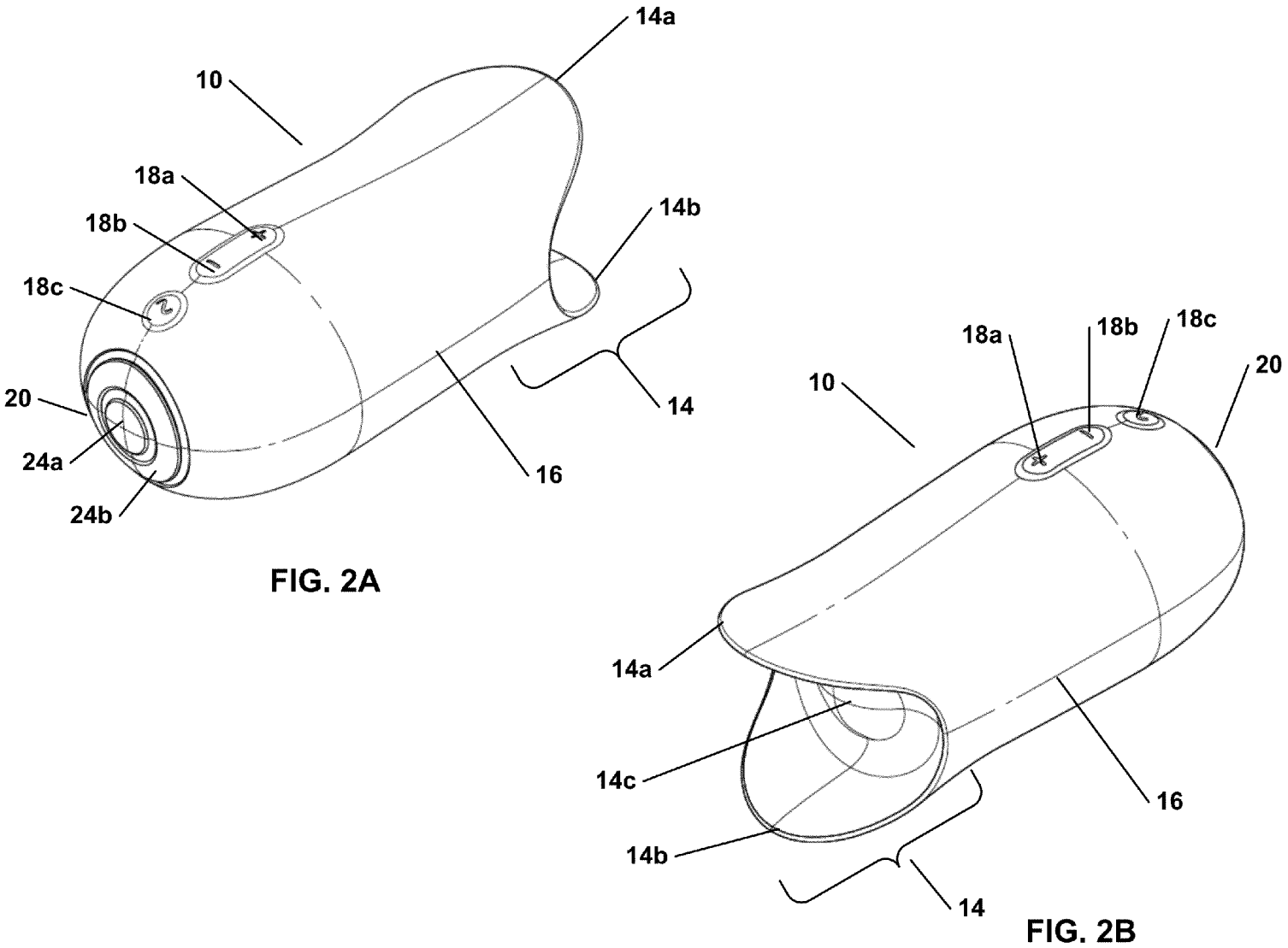
FIG. 2A is a rear perspective view of the massager of FIG. 1.
FIG. 2B is a front perspective view of the massager of FIG. 1.

Turning to the drawing figures, where similar numbers are used to represent similar features, FIGS. 1 and 2 show an example embodiment of the present invention, wherein a massager 10 includes a first end 12, a second end 14 and a midsection 16. In the present embodiment, the first end 12 is in the form of a base end that includes controls for various electronic features of the massager 10 and also houses most of the electronic components of the massager 10, as discussed below with reference to FIG. 3. The first end 12 is generally sized and shaped to provide a portion of the massager 10 for the user to grasp during use of the massager 10, but is also designed to provide a useable area for the massager 10. Accordingly, the majority of the first end 12 is substantially smooth and forms a continuous, rounded surface, with the exception of the controls 18 and the charging contacts 20.

Figure 8:
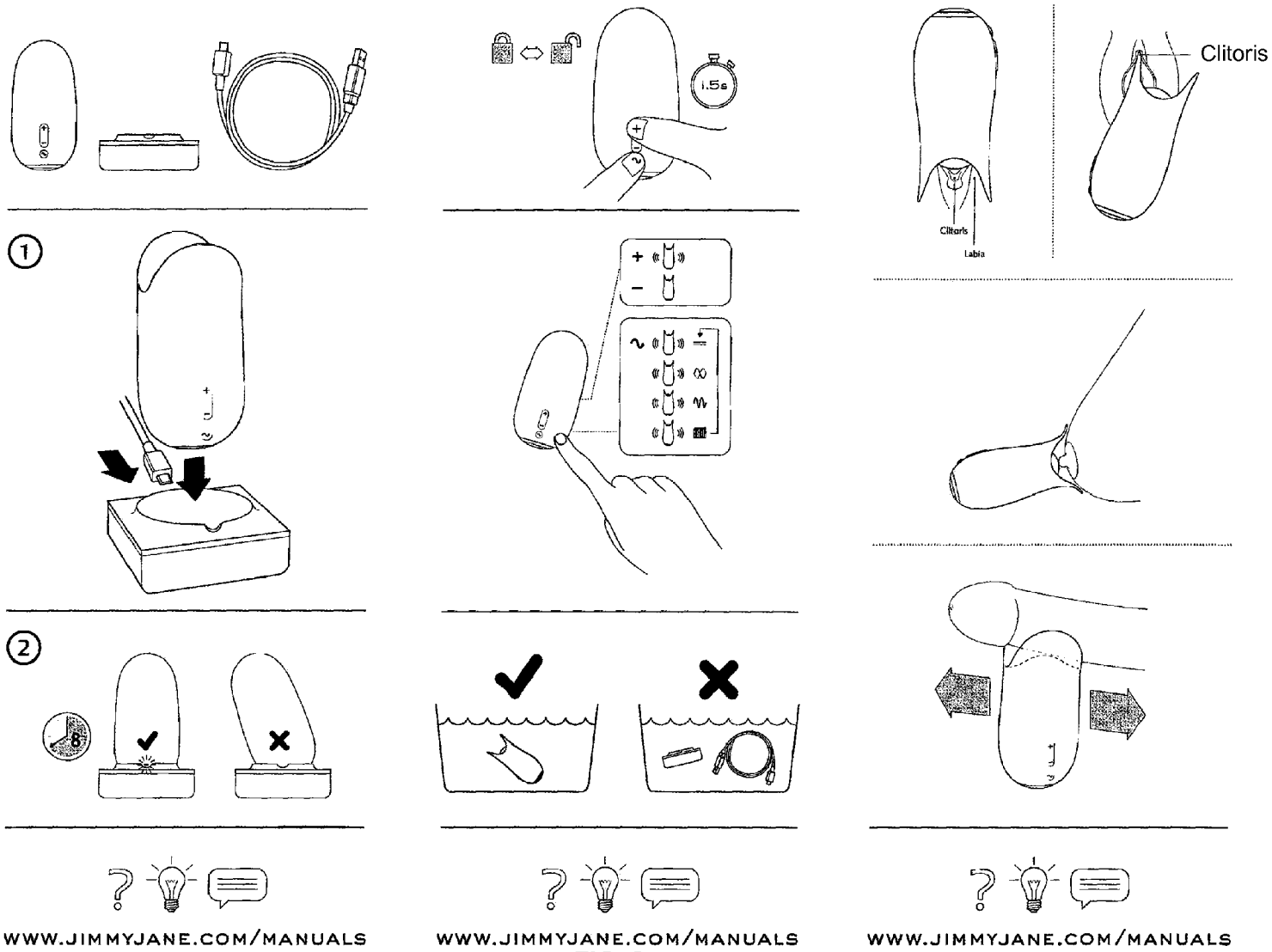
Figure 9:
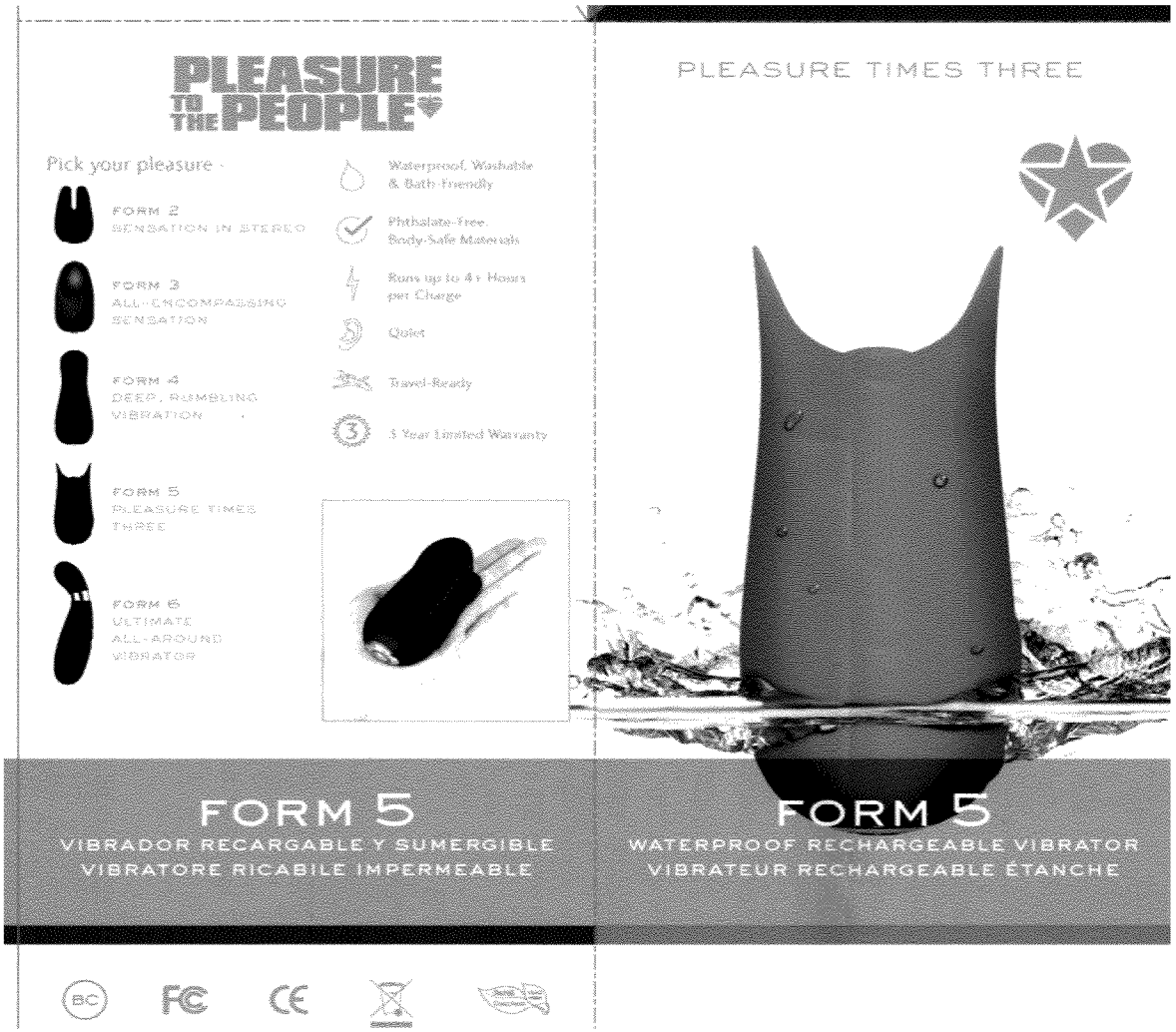
Figure 10:
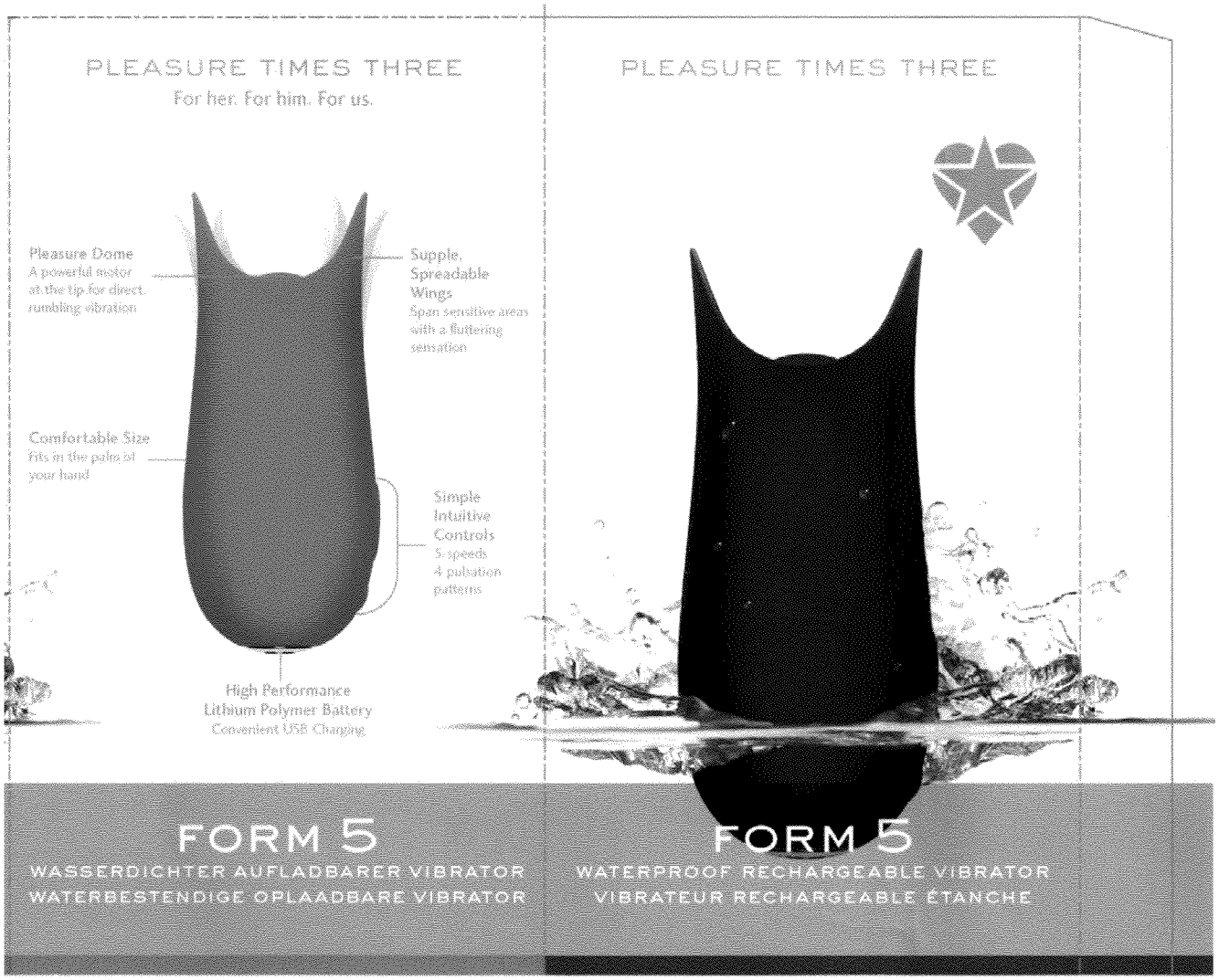
Figure 11:
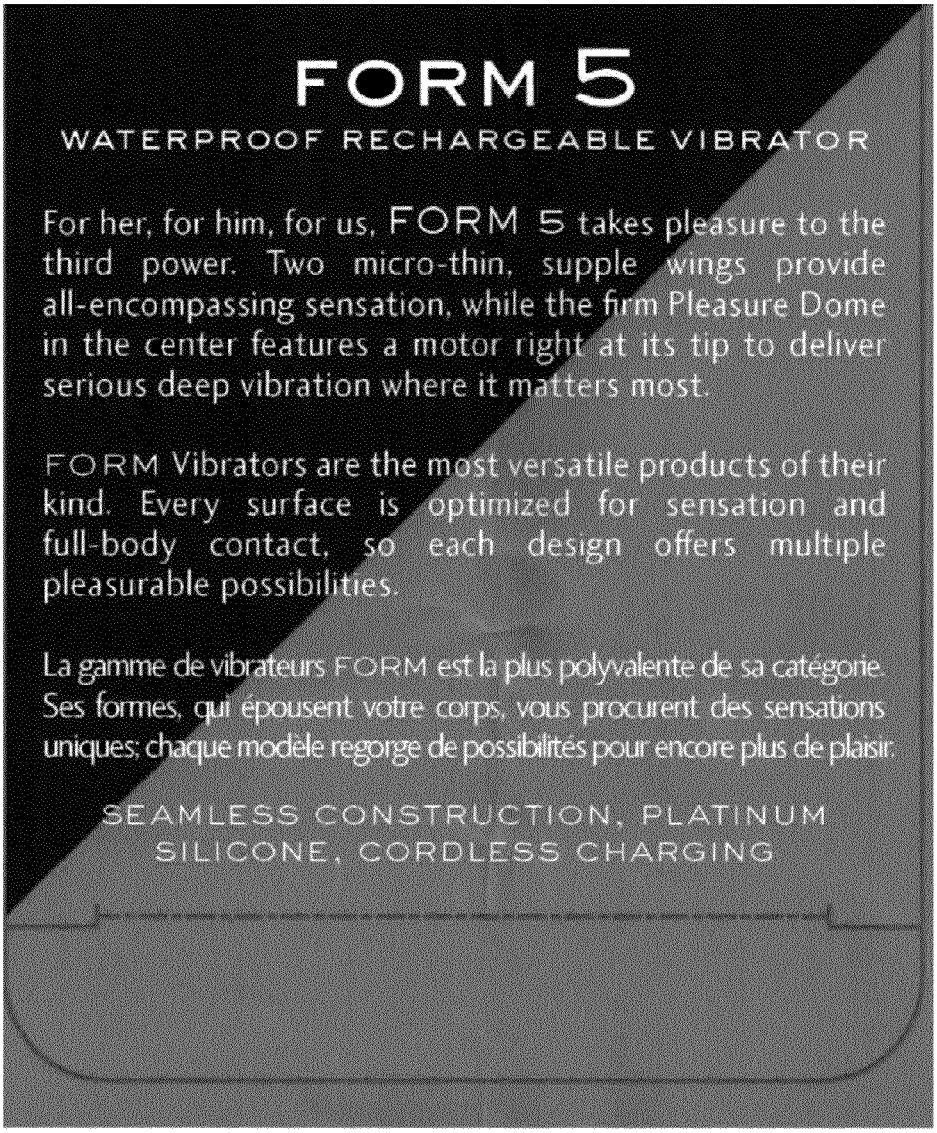
Figure 12:
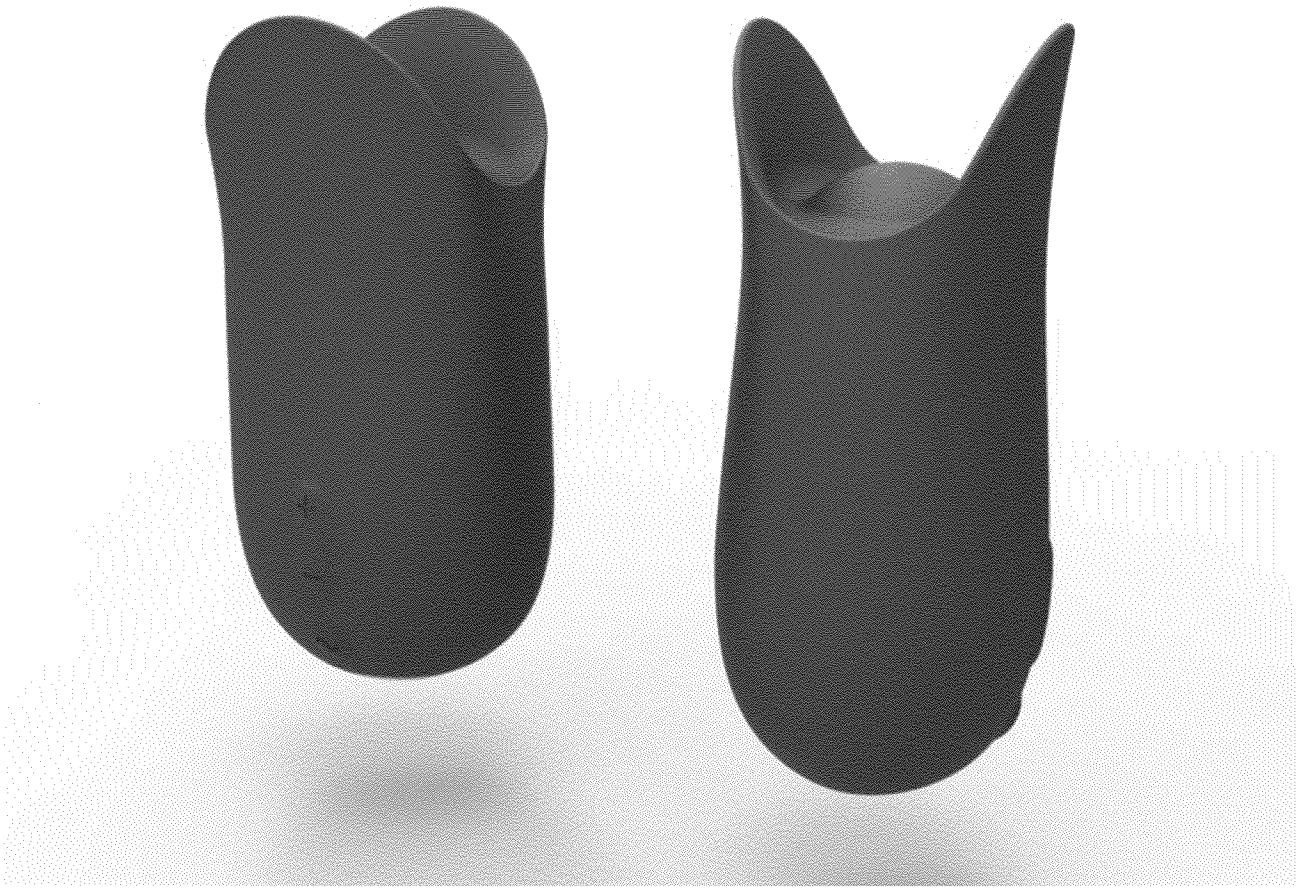
Figure 13:
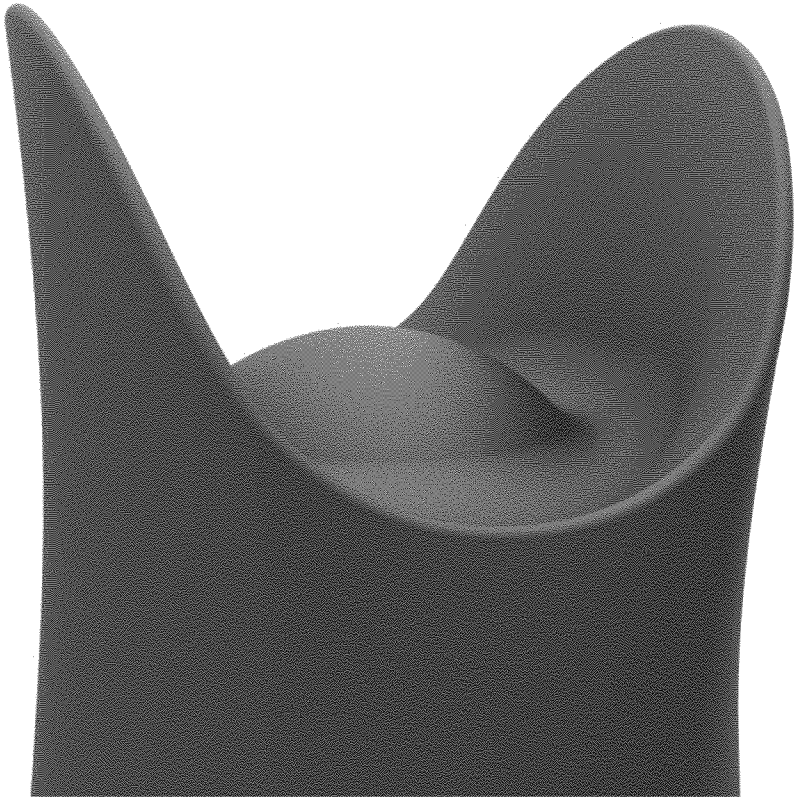
Figure 14:
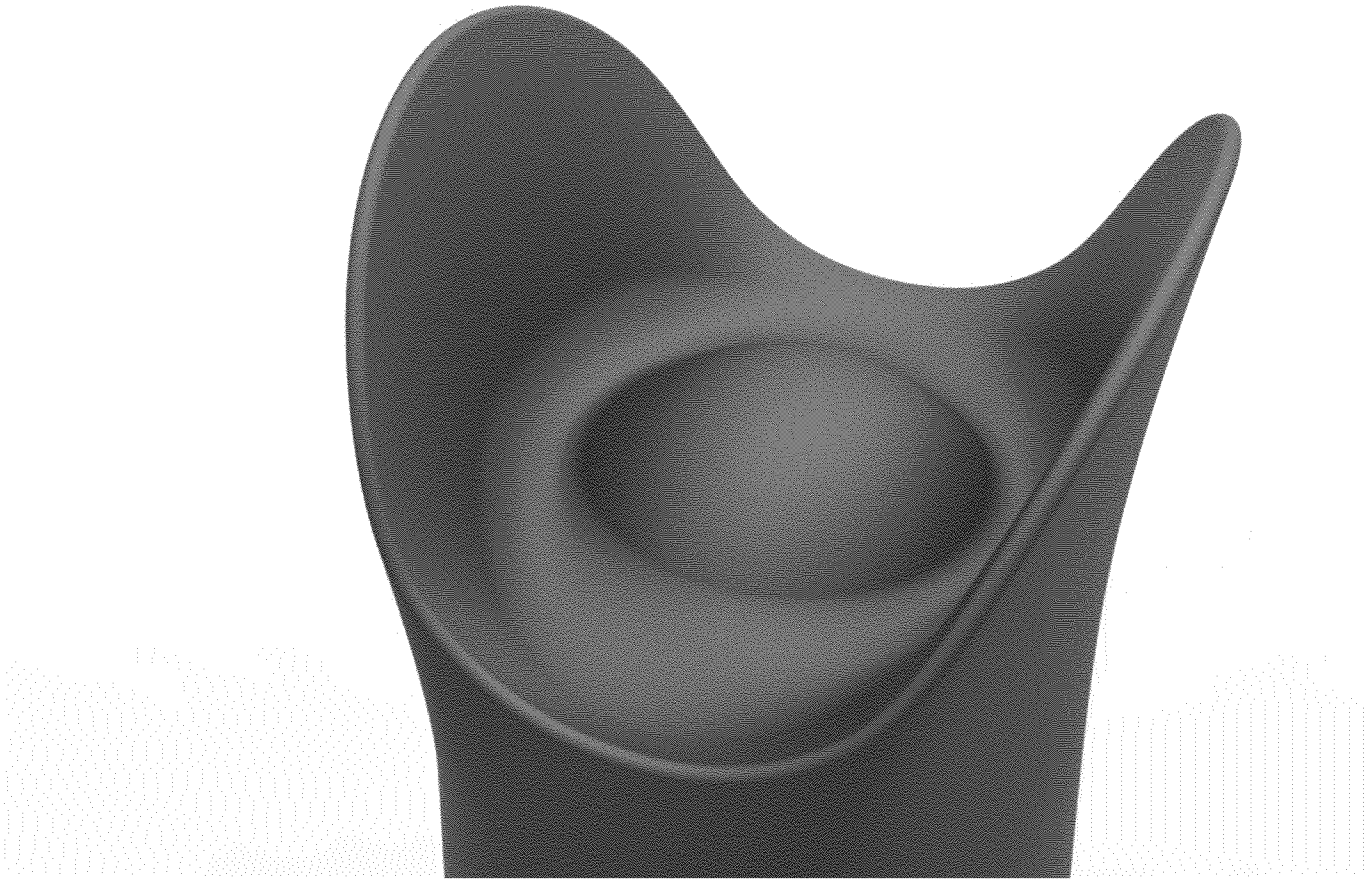
Figure 15:
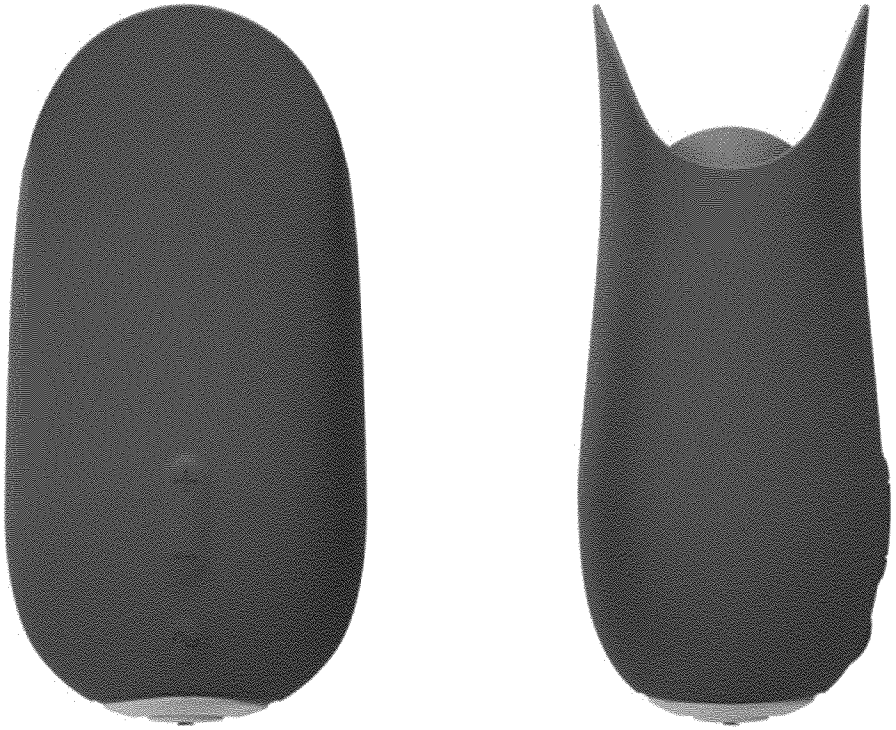
Figure 16:
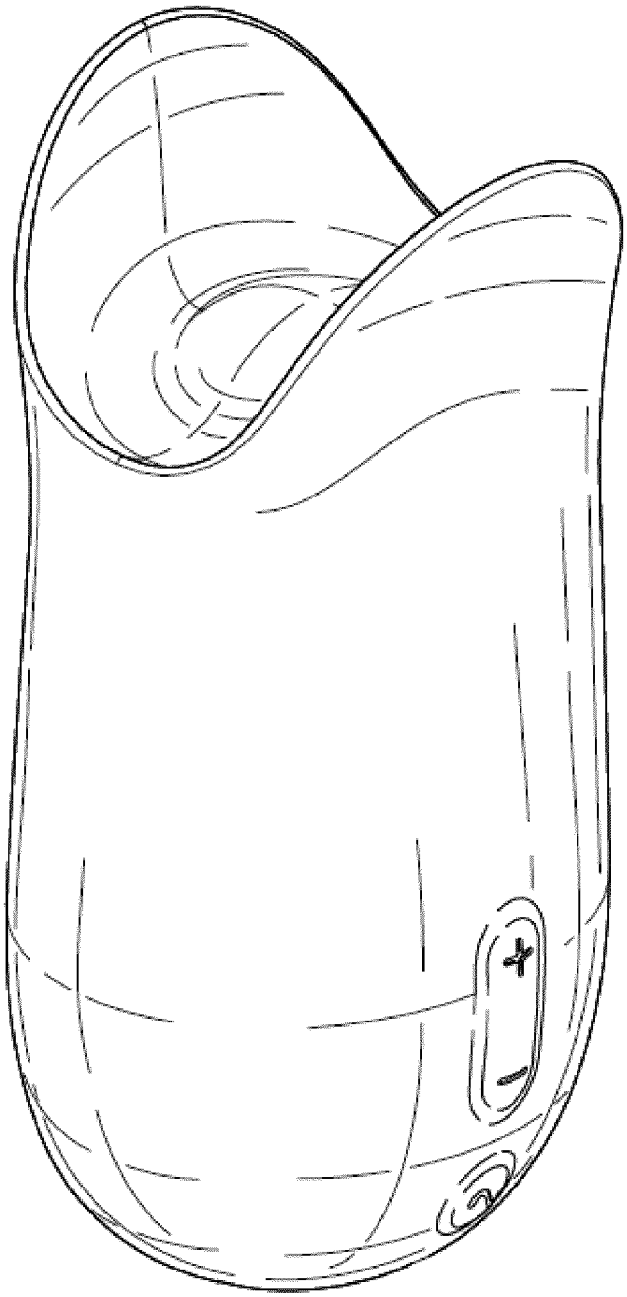
Figure 17:
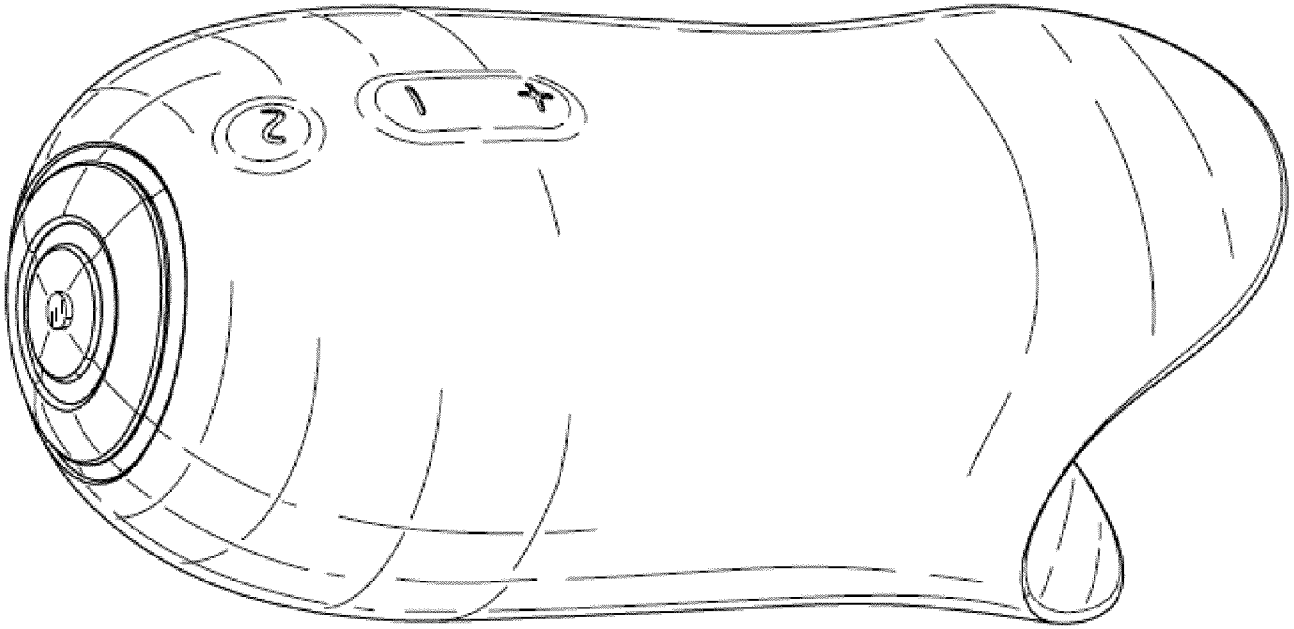
Figure 18:
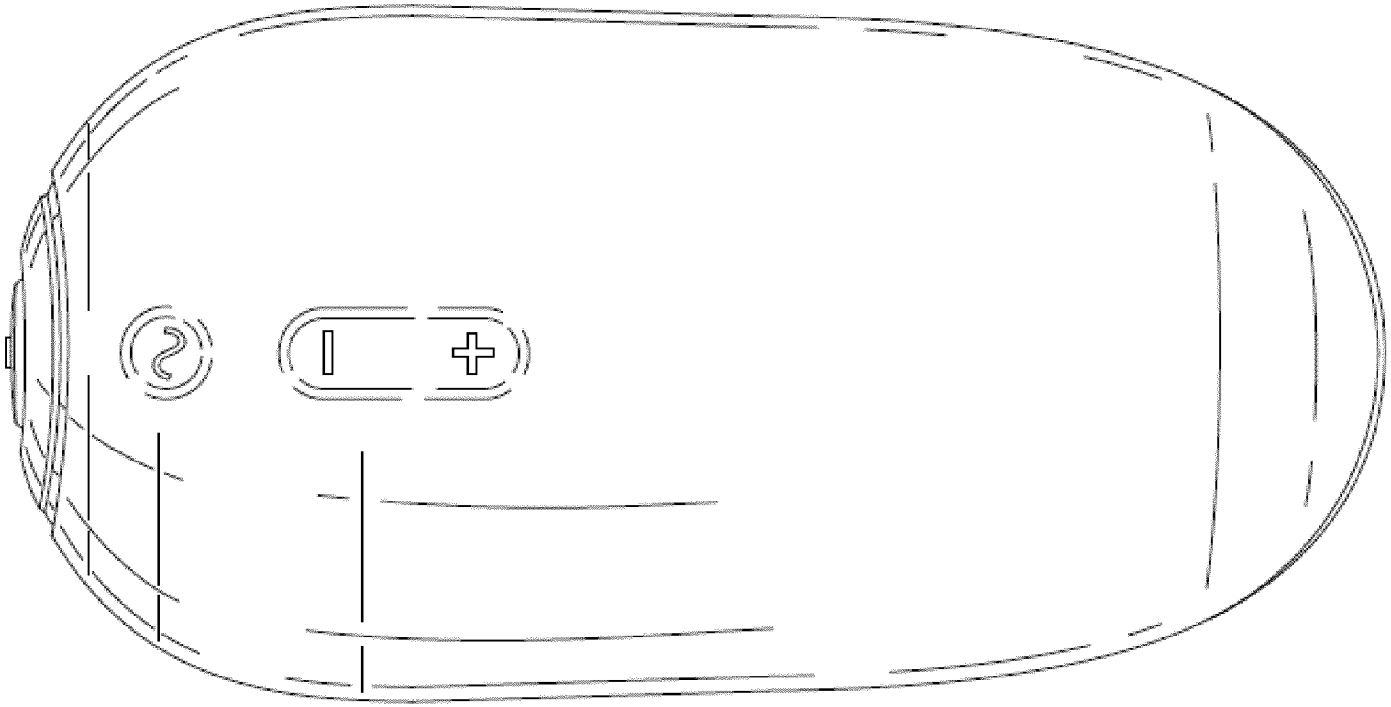
Figure 19:
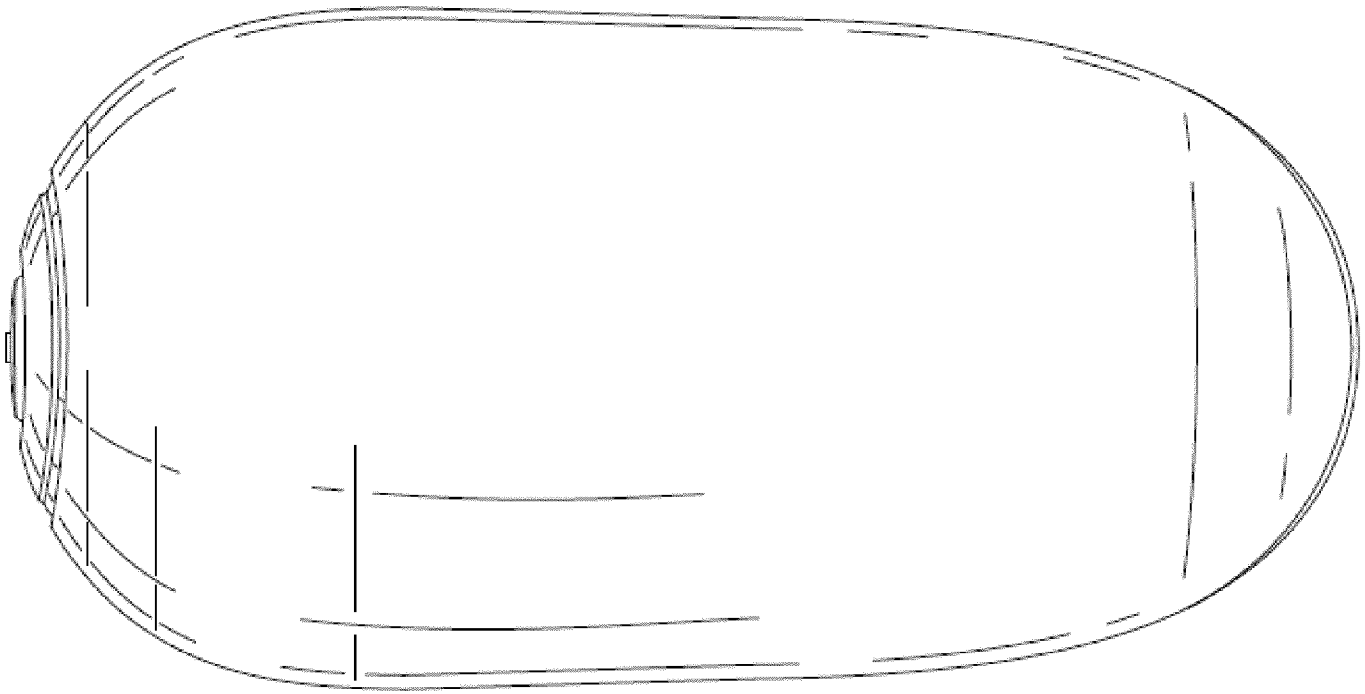
Figure 20:
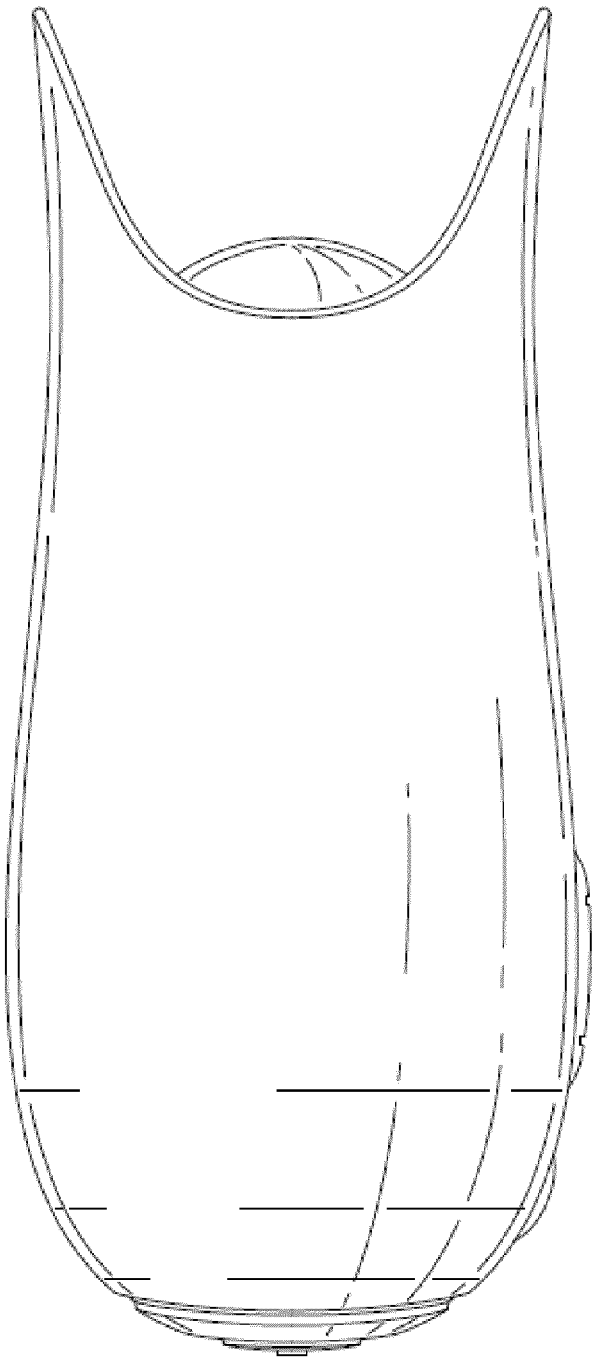
Figure 21:
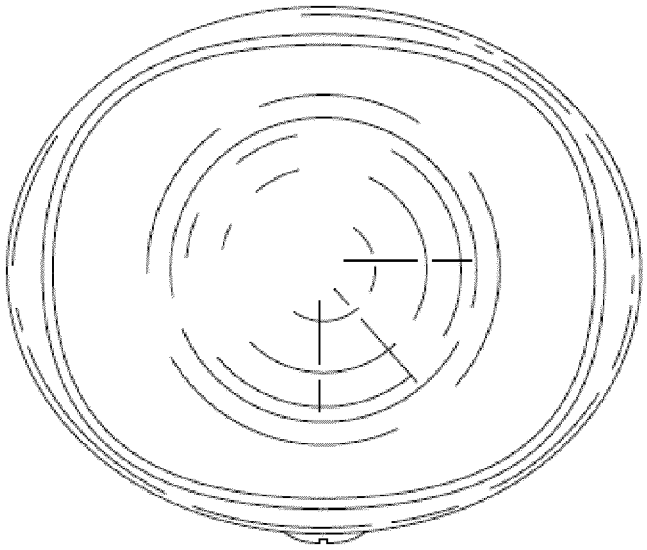
Figure 22:
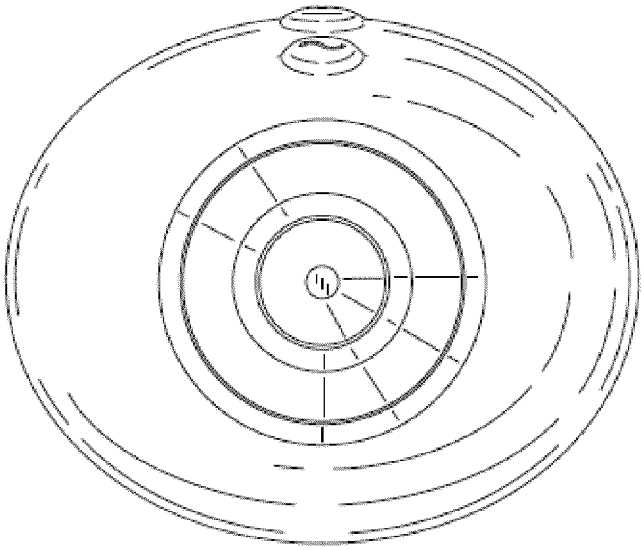

The second end 14 is generally intended to form the primary useable portion of the massager 10 that is configured to be applied to various parts of the human body to achieve various forms of massage, including relaxation massage, muscular/tissue massage, and erotic massage. FIG. 8, for example, shows the placement of the massager 10 for use in erotic pleasure.

The second end 14 has two wings 14*a* and 14*b* that "flutter" when the massager 10 is in vibration mode. This "flutter" is shown in FIG. 1 and depicted by the dashed lines. In prior art massagers, the outer material and the shape of the outer material were substantially rigid and fixed to the internal vibration mechanism such that the movement of the outer material was very confined and did not "flutter". The wings 14*a* and 14*b*, however, are made of a compliant material and are shaped to taper to thin distal end. The material may a flexible, rubbery material such as a silicone or a thermoplastic elastomer ("TPE"). It is the combination of this tapering and material selection that allows the ends of the wings to amplify the movement of the internal vibration mechanism. Further, the shape and construction of the wings 14*a* and 14*b* allows a user to spread those wings apart from each other to allow for a more appropriate and pleasurable massage. Finally, because the wings 14*a* and 14*b* are very compliant and tapered they provide a very supple vibration to a user.

The second end may also have a dome 14*c* that is constructed to be more rigid than the structure of the wings 14*a* and 14*b*. Because the dome 14*e* is more rigid than the wings 14*a* and 14*b*, it does not flutter; rather, it provides a more forceful and less supple vibration to the user. It is the variable rigidity of the second end 14 and the variability of the vibration strength and movement that allows a user to find the most pleasurable massage. The wings and dome can contact different parts of the user's body with varying vibration, so as to maximize the pleasure from the massager 10.

It is desirable that second end 14 be shaped to provide a smooth surface that can comfortably move while in contact with the human body. It is also important that the second end 14 be shaped to adequately direct the force applied by the user to the tissue upon which the massager 10 is used, without creating discomfort through areas of excessive pressure.

It should further be noted that the wings may be part of an outer skin or boot that can be stretched over an existing massager. For example, the parent of this patent application, U.S. patent application Ser. No. 14/474,256 to Imboden, et al. (hereinafter, "the '256 Application") entitled "Massage Device With flexible Substructure" and filed Sep. 1, 2014, the entire disclosure of which is incorporated by reference herein, includes at FIGS. 1-5 a massager. The wings 14*a* and 14*b* described herein may be formed of a compliant skin that can be pulled over the massager described in the '256 Application.

The midsection 16 generally forms the transition or connection between the first end 12 and the second end 14. Depending on the specific form of the massager 10, the midsection can take on a variety of specific shapes that may be largely dictated by the actual shapes of the first and second ends 12, 14. Generally speaking, the midsection 16 should be mainly smooth throughout and should form substantially smooth transitions with and between the first end 12 and the second end 14. In various embodiments of the massager of the present invention, the midsection 16 may contribute to aspects of the massage characteristics of the massager 10, as will be discussed below.

Figure 3A:
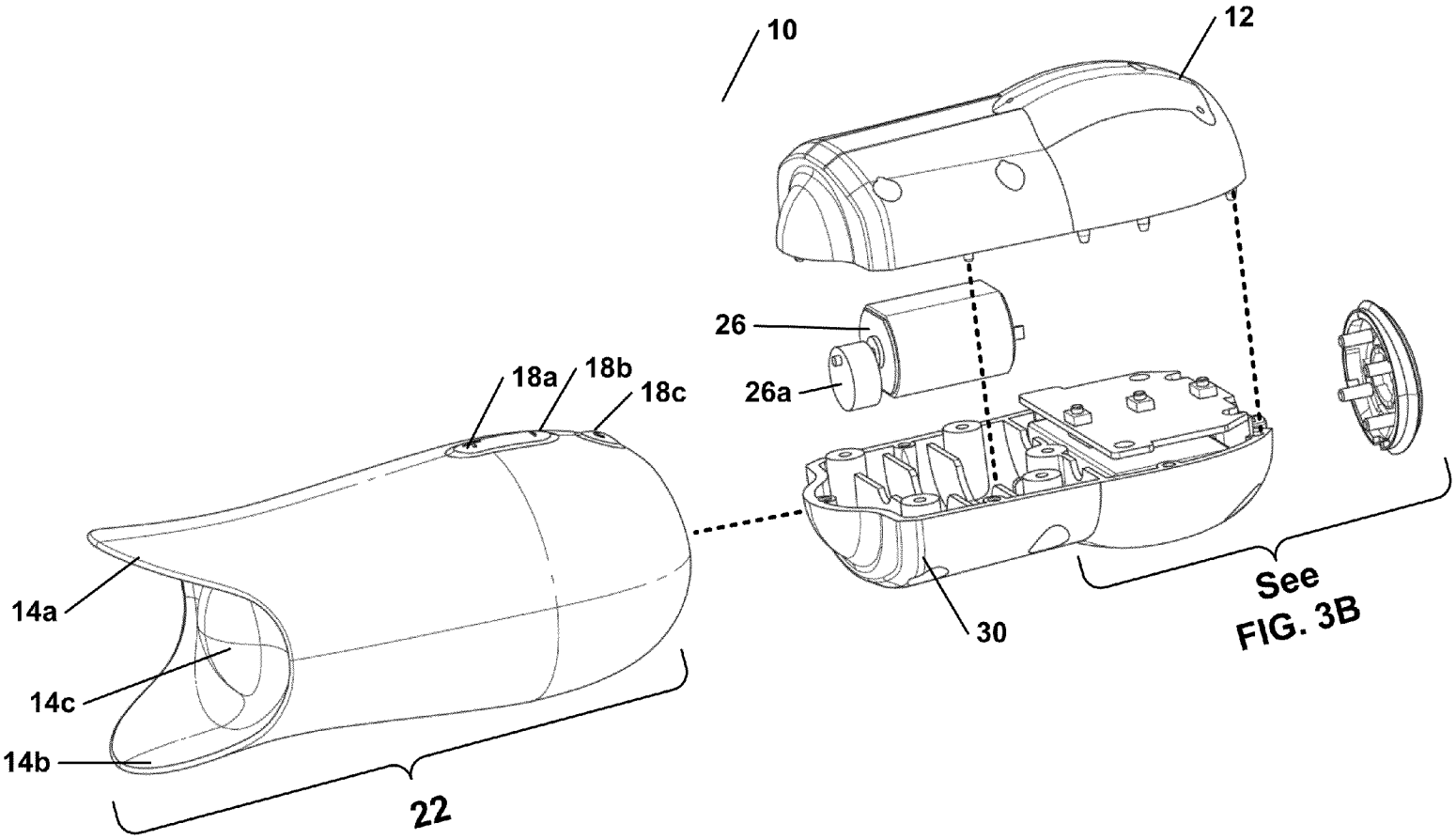
FIG. 3A is an exploded view of the massager of FIG. 1.
Figure 3B:
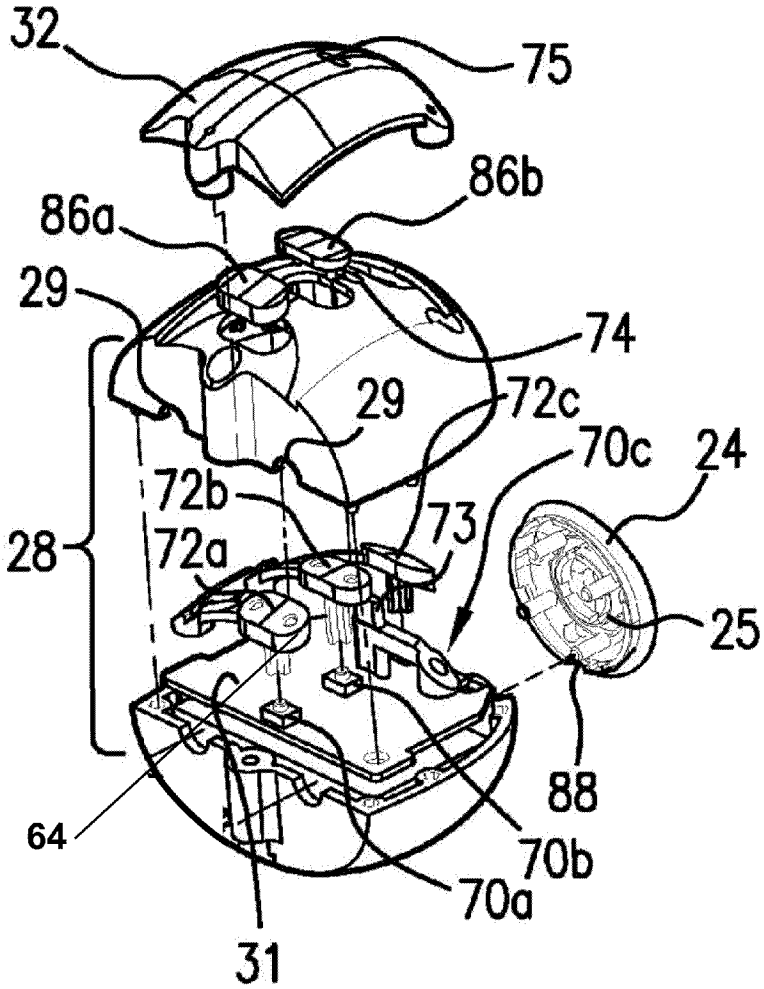
FIG. 3B is an exploded view of a portion of the massager of FIG. 1.

FIGS. 3A and 3B show an exploded view of the massager 10 that shows the structure of and relationship between both external and internal components of the massager 10. The massager 10 includes an outer boot 22 that forms most of the outside surface of the massager 10 and encloses its internal components. Preferably, the only portion of the outside surface of massager 10 that is not defined by the boot 22 is the contact surfaces 24, which are used to make an electrical connection between the massager 10 and a corresponding charging unit (discussed below) for purposes of recharging the massager 10 between uses. The internal components of the massager 10 include a motor unit 26, a control housing 28, and a substructure 30 that may be flexible. The internal components are assembled together and provide the structure for the overall shape of the massager 10, with the boot 22 being substantially flexible and compliant so as to provide a pleasant feel for the user and to smooth out the overall shape of the massager 10.

The control housing 28 also encloses most of the electronic components of the massager 10 such as a rechargeable battery and a printed circuit board ("PCB"). The PCB 31 includes buttons that are used to control the electronic functions of the massager 10, such as turning on and off the electronic motor held within motor unit 26 as well as controlling the speed at which the motor rotates. Further control functions of the motor are disclosed in U.S. patent application Ser. No.

11/971,825 to Imboden, et al. (hereinafter, "the '825 Application") entitled "Rechargeable Personal Massager" and filed Jan. 1, 2008, the entire disclosure of which is incorporated by reference herein. The PCB 31 also controls the charging of the battery and, accordingly, is electronically connected to the charging contacts 24*a*, 24*b* (discussed below).

In a preferred embodiment, the control housing 28 is structured so as to be useable in a number of different massage devices that have varying shapes for their respective midsections and second ends. For example, the mid-section and second end described in co-pending U.S. patent application Ser. No. 14/474,256 may be used.

In such an embodiment, the control housing 28 can have a shape intended to be common to the first end 12 of the device with a feature for connection thereto of different substructures. In the embodiment shown, the control housing 28 includes a pair of holes 29 formed between mating halves of the control housing 28 such that the two halves can be assembled to capture a mating portion of the substructure 30 such as a pair of mushroom tabs (not shown) to secure the flexible substructure 30 to the control housing 28. Preferably, an adhesive can also be used to further secure the attachment. The PCB 31 included in the control housing 28 can also be adapted to control common functions between various massager embodiments that share a common control housing. The PCB 31 can further be accessible during assembly of the device, such as by opening the housing to add additional elements to the PCB 31 to adapt the control features to the specific embodiment of the massager with which it is used. Such adaptations can include, for example, appropriate handling of the number and/or size of the vibrating motors used (which can result in varying power requirements) and can be achieved, for example, by soldering specific jumpers thereto, as would be understood by one of ordinary skill in the art. Variations of the PCB 31 that are programmable or otherwise customizable to work with additional variations in massager types and configurations are contemplated. For example, the PCB 31 can include flash memory or the like that can allow customization of massager control by changing firmware, rather than hardware.

The buttons 70*a*, 70*b*, 70*c* of the PCB 31 are positioned beneath a cover 32, which is substantially flexible such that when the user presses one of the controls 18*a*, 18*b*, 18*c*, the cover 32 deforms therebeneath. The cover 32 is adaptable to provide a transition between a common control housing 28 and midsections of various configurations that may be used in a number of devices having different midsection and second end shapes. The use of the cover 32 provides a smooth transition between the control housing 28 and the flexible boot 22, especially during manipulation of the controls 18*a*, 18*b*, 18*c*. The cover 32 further prevents any adhesives used during assembly of the massager 10 from interfering with the functioning of the controls 18*a*, 18*b*, 18*c*. Preferably, different covers can be used with corresponding flexible substructures wherein the different covers are configured to match the profile of the portion of the control housing to which they connect and to vary along the remaining outside surface, according to the desired shape of the flexible substructure. This arrangement allows for a transition to the common control housing 28 from the various flexible substructure shapes to extend farther toward the first end 12 than would otherwise be possible. A button tree 64 is positioned inside the control housing 28 and is structured to depress a corresponding one of buttons 70*a*, 70*b*, 70*c* in response to the deformation of the cover 32 when the controls 18*a*, 18*b*, 18*c* are depressed. Specifically, the button tree 64 includes lever arms 72*a*, 72*b*, 72*c* that correspond to the buttons 70*a*, 70*b*, 70*c* and provide a link through the cover 32 to the corresponding controls 18*a*, 18*b*, 18*c*. Preferably, the various forms of the cover that may be used in connection with the modular assembly structure described above are structured to maintain a similar "button feel" between different variations thereof. This button feel can include, for example, the force required to depress the controls and the distance of travel required for the manipulation of the controls to achieve their desired function. Consistent button feel can be achieved, for example, by forming the different variations of the cover to share a common thickness. Such a formation can result in a gap between the button tree 64 and the cover 32. In such instances, spacers 86*a*,86*b* can be included between the buttons 70*a*, 70*b*, 70*c* and the button tree 64 to take up this gap and to maintain a consistent travel distance for the buttons 70*a*, 70*b*, 70*c* compared to other embodiments.

In the embodiment shown, there are three controls formed on the boot 22, which include a "+" control 18*a* (which increases motor speed), a "−" control 18*b* (which decreases motor speed), and a mode control 18*c*. The mode control 18*c* preferably cycles through various additional electronic functions or massage modes. Examples of these modes include: constant, sine curve slow, sine curve fast, ramping, and pulsing. These modes can additionally include control of multiple motors, in embodiments of the massager including more than one motor. Examples of such modes are further described in the '825 Application. The controls 18*a*, 18*b*, 18*c* can also be used to activate a "secret mode" of operation for the massager 10 by, for example pressing specific ones of the controls 18*a*, 18*b*, 18*c* in a predetermined sequence. The secret mode can include the implementation of a certain vibrational characteristic for the massager 10 or can include the implementation of a "chaos" mode, whereby the motor is made to vibrate in a random one of its prescribed modes at a random power level for a certain period of time before the mode is switched to another randomly-selected mode, and so forth. The secret mode or function can be one that is not described in the manual that is distributed with the device when it is sold. The sequence may involve pressing a combination of buttons to unlock the secret mode. For example, the existing functional buttons on the devices may not provide access to that function or mode and a code must be entered by using existing buttons to unlock and activate the mode. In some instances, such a function may not be necessarily considered to be a "secret" to the user, but there may be no corresponding button that is designated to activate the mode. Pressing a combination of different buttons, such as pressing "+" twice and "−" once within a few seconds, or by pressing the "+" and "−" controls within about ½ second of each other three times in sequence, for example, can trigger the mode. In other words, for example, the buttons for providing different functions on the massager are being used in an unconventional way (not having a known set function for their use in combination, or not corresponding to their designated use) to cumulatively find a new operation of the massager. In other embodiments, such "secret" functionality may be related to a game function of the massager. This can include using the geometry of the massager, in connection with the vibration of the motors, to, for example, cause the massager to rotate on a surface for a random amount of time or through a random rotational distance. This allows the massager to be used to control a "spin-the-bottle" type game.

In an exemplary embodiment of a control scheme that can be used in connection with the massager 10, the vibration level can be controlled by two methods:

1) by clicking the "+" control 18*a* or the "−" control 18*b* according to the following scheme:

Clicking "+" control 18*a* once increases the vibration level by one level

Clicking "−" control 18*b* decreases it by one level

Clicking "+" when massager 10 is on level 5 (the top speed) has no effect Clicking "−" when massager 10 is on level 1 stops all vibration, turning massager 10 off; or, 2) by pressing and holding the "+" control 18*a* or "−" control 18*b* according to the following scheme:

Pressing and holding "+" control 18*a* causes the vibration level to step up through the levels, with 0.25 seconds between steps, until the button is released, or the massager 10 reaches its top speed (level 5).

Pressing and holding control 18*b* causes the vibration level to step down through the levels, with 0.25 seconds between steps, until the button is released, or the massager 10 reaches level 1. (To then turn the massager 10 all the way off, control 18*b* must then either be held for an additional 0.5 seconds, or can be clicked or pressed again.)

In addition to the various controls of the vibration of the massager 10 when the device is turned on, the controls 18*a*, 18*b*, 18*c* can be used to turn off the massager 10 and to enter a "lock" mode, preferably in accordance with the following exemplary scheme:

1) Behavior when the massager 10 is "off":

Clicking or pressing and holding "−" control 18*b* or mode control 18*c* has no effect when the massager 10 is off. (Clicking or pressing mode control 18*c* does not change the mode of vibration.)

Clicking "+" control 18*a* turns the massager 10 on and begins vibration at level 1.

Pressing and holding "+" control 18*a* turns the massager 10 on and begins vibration level 1 and continues to ramp up the speed until the button is released. The massager 10 will then continue to run at that speed When the massager 10 is turned on, the mode is always the same as when the massager 10 was last turned off.

2) "Locking" and "unlocking" the massager 10:

Pressing and holding "+" control 18*a* and mode control 18*c* simultaneously for 1.5 seconds locks and unlocks the massager 10.

When the massager 10 is on, and "+" control 18*a* and mode control 18*c* are pressed simultaneously for 1.5 seconds, the motor (or motors, if multiple motors are used) stops, and the massager 10 is locked.

When the massager 10 is off, and the "+" control 18*a* and mode control 18*c* are pressed simultaneously for 1.5 seconds, the motor stays of and the massager 10 is locked.

Whenever the massager 10 is unlocked it will turn on and begin vibrating at level 1 and in the same mode it was in just prior to being locked.

Placing the massager 10 in the base 90 unlocks it and puts it in the off mode. Therefore the massager 10 is always in the off mode (and not locked) when it is removed from the base 90.

The control methods described are by way of example only and are not intended to be limiting with respect to the operation of the massager 10. Different control schemes, employing more, fewer, or different controls can be implemented by those with ordinary skill in the art.

The control housing 28 further preferably includes an LED light assembly 73 that is comprised of an LED light source on the PCB 31 and a light pipe that carries the light emitted by the LED light source to the end thereof. The light carried to the end of the light pipe of the LED assembly 73 is visible through a hole 75 in the cover 32 in the control housing 28 and further visible through the boot 22 due to the preferred material characteristics thereof. The LED light assembly 73 can be used to provide information to the user of the massager 10 regarding the status of the massager's operation. For example, the LED light assembly 73 can indicate when the massager 10 is on, off, or in locked mode by flashing or constantly illuminating according to a prescribed pattern. The LED light assembly 73 can also provide information regarding the charge level of the battery, for example by illuminating for a predetermined amount of time or by flashing a predetermined number of times when the massager 10 is removed from its charging base 90. Additionally, a larger LED light assembly, a plurality of LED light assemblies, an electroluminescent panel, an OLED or other light source can be included in the massager 10, possibly at varying locations throughout the interior of massager 10, such as beneath the boot 22 on or near the second end 114, so as to illuminate substantially the entire form of the massager 10 or to illuminate a portion of the massager 10 at one or more desired locations. Such "night light" or lighting functions could also include forming the internal components, where possible, from a translucent material and could be incorporated in the communicative aspects of the LED light assembly 73, discussed above.

The boot 22 is preferably formed from a flexible, rubbery material such as a silicone or a TPE. In a preferred embodiment, the boot 22 is molded as a separate, unitary structure and is fitted over the assembled internal components of the massager 10. The flexible nature of the silicone or TPE allows the boot 22 to flex and stretch, as necessary, to fit over any larger portions of the massager 10 during assembly. A flexible adhesive, such as a silicone-based adhesive is preferably applied between the internal components of the massager 10 and the inside surface of the boot 22 to maintain the appropriate position of the boot 22. Preferably, a low-viscosity adhesive is applied to achieve a substantially thin and even layer of adhesive. The use of an adhesive to secure the boot 22 to the internal components of the massager 10 helps to keep the boot 22 smooth and substantially free of bumps and wrinkles during use, particularly when the massager 10 is bent or flexed as allowed by the flexible midsection 30. Further, the use of adhesive allows the boot 22 to provide additional structural support for the internal components of the massager 10, such as between the motor housing 26 and the flexible substructure 30, or between the flexible substructure 30 and the control housing 28. The material used to form the boot 22 preferably has a durometer of between Shore 35 A and Shore 44 A, which provides a substantially soft and pliant tactile quality for the boot 22 when formed at a preferred material thickness of between 1 mm to 10 mm and, more preferably, between 2 mm and 5 mm, it is noted that the preferred material thickness can vary with the desired material characteristics of the boot 22, such as flexibility, softness, etc.

The boot 22 forms a flexible skin that preferably waterproofs the entire structure of the massager 10, with the exception of the single boundary at its opening. This opening is substantially sealed by the adhesive between the boot 22 and the control housing 28 around the opening of the boot 22. A portion of the control housing 28 that is located within the opening of the boot 22 is substantially waterproofed by using adhesive to seal any openings or seams therein, including the seam between halves of the control housing 28 and the openings for the leads that connect the charging contacts 24*a*, 24*b* to the PCB 31 through the control housing 28. A charging contact cap 20 fits into the opening in the boot 22 and is affixed to the control housing 28. The charging contact cap 20 is comprised of two metal contacts 24*a*, 24*b* that are insert-molded into a plastic structure. This production method (rather than assembly of separate parts) essentially fuses the parts together, making them a sealed, unified assembly. The assembly of the charging contact cap 20 onto the control housing 28, which is (preferably achieved by a combination of pressure-fit and glue, captures a portion of the boot 22 therebetween, providing pressure on the boot 22, around its opening, to create a seal therebetween and to prevent the boot 22 from pulling away from the control housing 28 around the opening thereof or from the charging contact cap 20 around the edge thereof. An O-ring or gasket, preferably formed from silicone, is positioned within a channel 25 formed in the charging contact cap 20 between the charging contacts 24*a*, 24*b*. The channel 25 is positioned to abut a portion of the control housing 28 beneath the charging contact cap 20, forming a seal therebetween, and, accordingly, isolating the charging contacts 24*a* and 24*b* and their respective leads from each other. This arrangement helps to substantially prevent shorting between the contacts 24*a* and 24*b* due to water that may enter beneath the outer portion of the charging contact, as defined by the channel 25. The result of this preferred combination of sealing measures preferably ensures a substantially waterproof seal, resulting in a completely-submersible massager 10. Additional waterproofing measures can be employed within the massager 10, such as by forming joints between mating parts of the control housing 28 with v-grooves that substantially accumulate glue therein when used to secure the parts together. The use of adhesive to secure the boot 22 to the internal components of the massager 10, as mentioned above, also helps to waterproof the massager 10 by substantially sealing the boot 22 over any seams in the motor housing 26 or the control housing 28.

In a preferred embodiment, it may be desired to allow ingress and egress of air from the inside of the massager 10 to the outside to prevent separation of the boot 22 from the internal components of the massager 10 due to changes in air pressure caused by varying altitude or temperature. To provide for this ingress and egress, a selectively permeable membrane can be included in the control housing 28. The selectively permeable membrane is (preferably formed from Gore-Tex™ or other similar materials that are constructed to allow permeation by air, but not by water or other liquids. Accordingly, this structure acts as a valve for air movement, while retaining the desired waterproofing characteristics of the the massager 10. Adequate movement of air through such a valve can be achieved through an area as small as 3 $mm^2$ or less, and more preferably 1.5 $mm^2$ or less. The valve is preferably in the form of a Gore-Tex™ membrane that is secured into an appropriately-sized section of plastic tubing, preferably by insert molding the tubing around the Gore-Tex™ membrane or by alternative methods such as adhesive, heat seating, ultrasonic welding or the like. In an alternative embodiment, a mechanical valve, such as a check-valve or the like can be used. The valve is then secured, preferably by glue or alternatively by ultrasonic welding or the like, into a corresponding hole in the control housing 28. The valve hole is preferably positioned on the control housing 28 so as to locate the valve beneath the charging contact cap 20 in the portion thereof that is outside of the channel 25. A notch 88 is preferably formed in the charging contact cap 20 to allow the air passing through the valve to escape therethrough to the outside of the massager 10, or vice-versa.

The motor unit 26 contains an electronic motor with an output shaft having an offset weight 26*a* attached thereto (see FIG. 6 detail and the description of the '825 Application), such that a vibration is created by the motor when running. The motor is electronically connected to the PCB 31, which controls and powers the motor via the battery, by wires that run through the substructure 30. In the embodiment shown, the motor unit 26 is positioned within the second end 14 of the massager 10. Although other arrangements are possible, the arrangement shown in FIGS. 3A and 3B is preferred, where the size and shape of the second end 14 permits, because it achieves the maximum amount of transfer from the vibrating motor to the point of application for the massager 10.

The substructure 30 may be made flexible such that it provides a level of compliance or flexion to the structure of the massager 10. Depending on the overall form of the massager 10, it might be desired to have different portions thereof be compliant or flexible, but in the embodiment shown in FIGS. 1-3B, it is desired to include flexibility between the first end 12 and the second end 14. The flexibility provided by the flexible substructure 30 has many benefits, including making the massager 10 more compatible with different portions of the human body or to compensate for variations within specific body parts between different individuals. Additionally, the flexibility can increase comfort and provide a more life-like feel for the massager 10. It can also allow the user to change, to an extent, the relative position of different portions of the massager 10, in this case the first end 12 and the second end 14, which can provide variations within the sensations provided by the massager 10 and/or allow the user to provide sensation to different body parts simultaneously. In an additional embodiment, the flexible substructure 30 can be formed to have a certain amount of "memory", either by material selection or by including additional structures therein, such as pliable wire, hinges, spines, a flexible conduit or the like. Such additional structures would preferably be substantially covered by, or embedded in, the material of the flexible substructure 30. Generally, the amount of memory provided will be such that the selected shape would not significantly change under the force of normal use, but can be changed or adjusted by the user when desired. In some embodiments, the position can be selectively locked and unlocked by the user. The flexible substructure 30 also provides support for the motor unit 26 within the massager 10, protects the wiring connections between the motor unit 26 and the control housing 28, and supports the outer boot 22 during flexion of the massager 10 so that the skin formed by the boot 22 is as smooth as possible before, during, and after flexion. Preferably, the flexible substructure 30 is formed from IPE, or another flexible material such as silicone or the like, of a higher durometer than that used for the material of boot 22. Depending on the desired characteristics of the flexible substructure 30, the durometer of the TPE used can preferably fall within a range of 44 Shore A to 70 Shore A. Such characteristics include the desired thickness of both the substructure 30 and the portion of the massager 10 in which it is used, the desired flexibility, the structural support of the motor unit 26 and the amount of vibration transmission through the flexible substructure 30 that is desired, among others. Additionally, the physical structure of the flexible substructure 30 can be tuned to provide the desired flexion/compliance characteristics. Ribs can also be integrally formed into the shape of the flexible substructure to change the flexion characteristics thereof, as desired. Additionally, the connections to adjacent or enclosed parts can be adjusted to change the flexion or compliance characteristics. For example, the distance which the motor unit 26 extends into the flexible substructure 30 in the embodiment of FIGS. 1-3B can be changed to yield different characteristics for the assembled structure. If desired, a first and second direction different from the horizontal and vertical direction mentioned above may be implemented (e.g., not in perpendicular orientation to each other).

Figure 4:
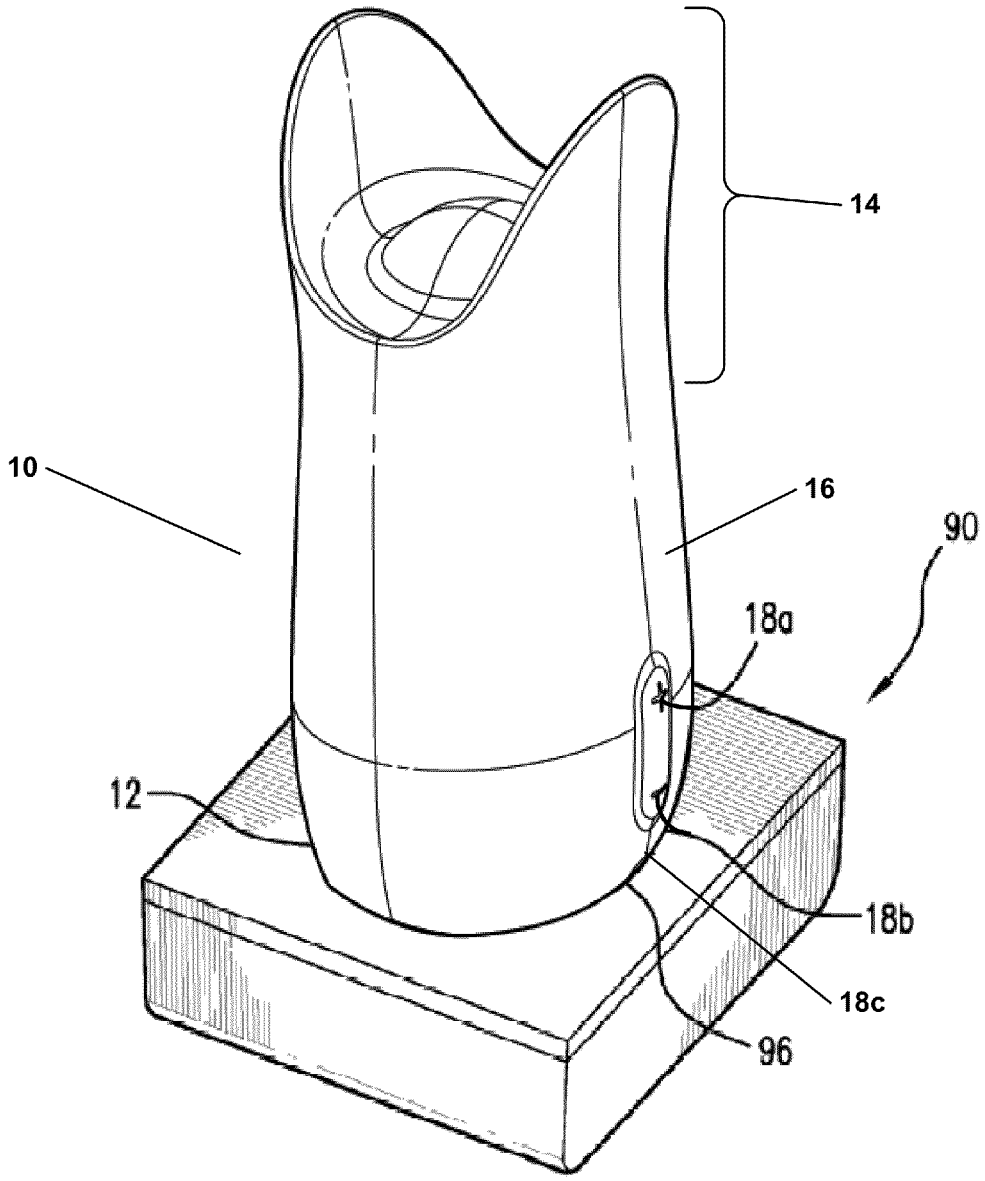
FIG. 4 is a perspective view of the massager of FIG. 1 assembled with a charging base.
Figure 5:
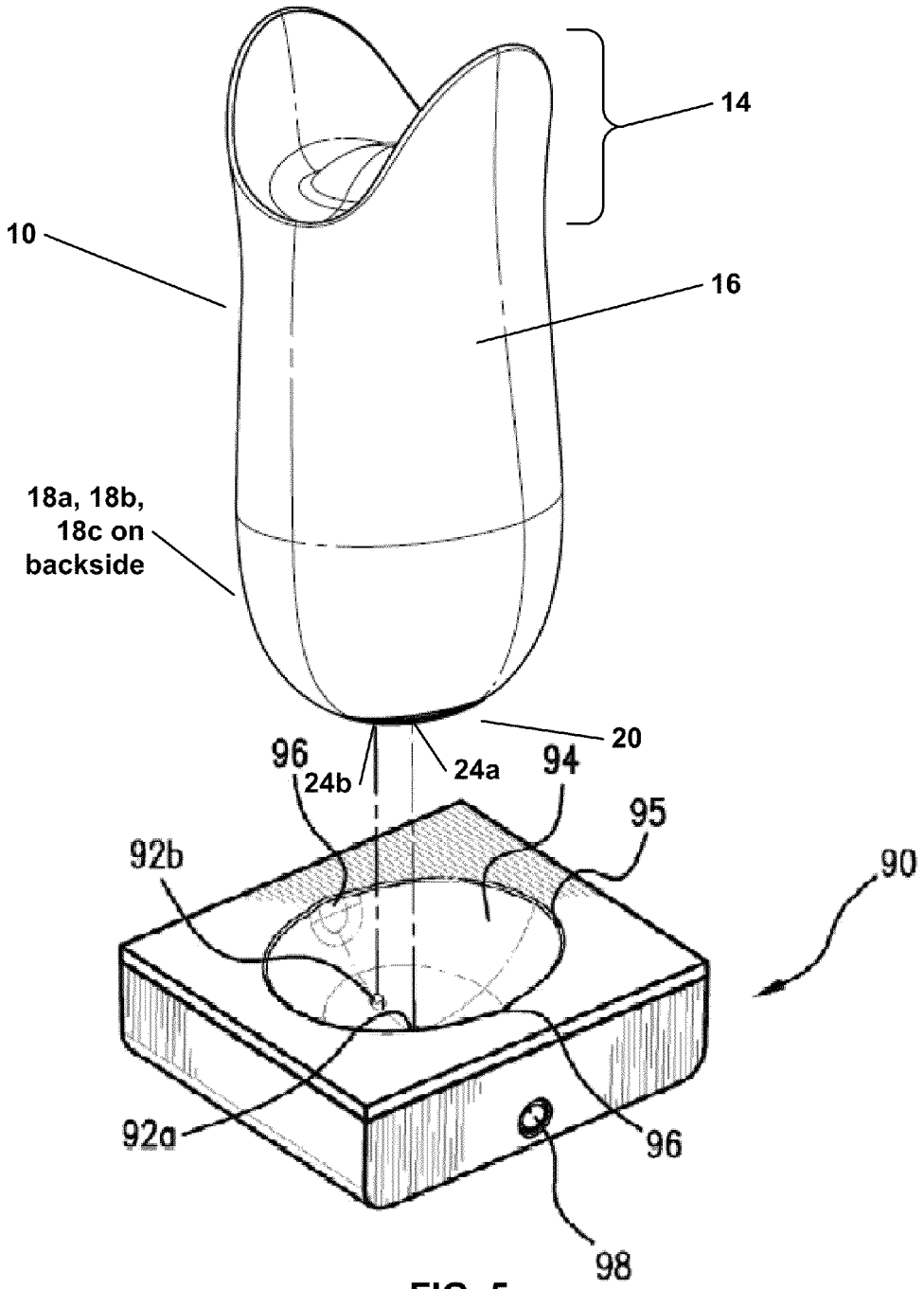
FIG. 5 is an exploded view of the assembly of FIG. 4.

FIGS. 4 and 5 show the use of an embodiment of a charging base 90 with an embodiment of a massager 10. The charging base 90 has a pair of electrical contacts 92*a*, 92*b* that align with respective ones of the contacts 24*a*, 24*b* included in the charging contact cap 20 to provide positive and negative connections to provide power to the massager 10, preferably for recharging the battery contained within the control housing 28. The charging base 90 is preferably formed to be as low as possible while still retaining the massager 10 on the base 90 so as to maintain electrical contact between the charging contacts 24*a*, 24*b*, and the contacts 92*a*, 92*b*. In a preferred embodiment, as illustrated in FIGS. 4 and 5, the base 90 is further structured to hold the massager 10 in a substantially vertical arrangement, although other configurations are possible. It is possible to construct a number of different massagers according to the general principles of the present invention that all work properly with a similar charging base, such as that shown in FIGS. 4 and 5. For example, all such massagers could have the same general shape for the portion of the first end 12 that surrounds the charging contact cap 20 (which could also be substantially similar between different massager variations). This portion would be that which fits within the cavity 94 to provide the desired support for the massager 10. The various shapes of the different massagers can diverge after such a portion. The lower the height of the base 90, the more easily a smooth transition between the common and unique portions of the various massagers can be made. Having the massager 10 "standing" in a substantially vertical, or upright, position is generally intuitive and ergonomic for the user that is, such an orientation makes it easy to pick up and put down the massager 10. Additionally, a base that has a low profile makes it easier to place the massager 10 into the charging position without requiring excessive accuracy. Preferably, the base 90 is structured such that it is relatively wide in the horizontal (i.e. X-Y) plane so that it will not tip over, even when the massager 10 is inadvertently placed in the base 90 on an angle. Additionally, the base 90 is preferably low enough such that the controls 18*a*, 18*b*, 18*c* and the LED light assembly 73 are substantially visible when the massager 10 is on the base 90, although a portion of the control 18*c* may be not be visible. Other configurations for the base 90 are contemplated, such as a configuration with no indentation surrounding the contacts 92*a*, 92*b*, but rather strategically placed supports, preferably at least two, that provide support to key areas of the massager 10. Such a configuration can allow for further variations among different forms of the massagers with which base 90 can be used.

As shown in FIG. 5, the contacts 92*a* and 92*b* of the base 90 and the contacts 24*a* and 24*b* of the massager 10 are preferably formed to reduce the accuracy with which the massager 10 must be placed on the base 90 in order to make a proper electrical connection therebetween. For example, in the embodiments shown, the contacts 24*a* and 24*b* of the massager 10 are in the form of concentric rings, and the contacts 92*a* and 92*b* of the base 90 are in the form of pins, spaced radially within the cavity 94 to align with one of the rings. This allows contact to be made regardless of the rotational orientation between the massager 10 and the base 90 along the long axis of the the massager 10. Further, by making the contact rings 24*a* and 24*b* substantially wider than the pins 92*a* and 92*b*, the angle of placement at which appropriate contact can be made is increased.

Of course, by lowering the height of the base 90, it is possible that the overall stability of the massager-base interface might be adversely affected. Several features can be implemented to overcome these effects. For example, it can be important to ensure that the surfaces of the cavity 94 and the portion of the first end 12 that fit therein substantially match around the upper edge 95 of the cavity 94 to achieve an accurate fit therebetween. To allow for a proper fit between the first end 12 of the massager 10 and the cavity 94 of the base 90 despite variations in either surface, it is preferably to form the cavity 94 such that it diverges from the substantially matching fit with the massager 10 at upper edge 95 to an offset distance of between 0.1 mm and 1 mm, and more preferably about 0.5 mm in the area surrounding the contact 92*a*. Additionally, the surface of the cavity 94 can be made of substantially smooth and polished polycarbonate (PC) or Acrylonitrile Butadiene Styrene (ABS) plastic that will positively interact with the somewhat-tacky surface of the soft silicone or TPE boot 22 to provide increased adhesion. A notch 96 can be formed near the upper edge of the cavity 94 to provide clearance for the control 18 of the massager 10 and to "key" the massager 10 in place on the base 90. Because the contacts 24*a* and 24*b* are concentric, it would be possible to have multiple notches 96 to provide clearance. Further, while it may be desired to include a spring force on the contacts 92*a* and 92*b*, to increase the compliance thereof when making contact with contacts 24*a* and 24*b*, it may further be desirable to make such a spring force lower in value so that they do not push the massager 10 off of the base 90. A power input 98 allows for the connection of the charging base 90 to a power source, such as an A/C outlet via a power adapter or the like.

In some embodiments, the vibration source can be disposed distal from the massage end of the massager 10. By placing the vibration source distal from the point intended to massage, the flexion movement of the massage end can be greater than when the vibration source is placed proximate the end to be held by a user. Furthermore, placing the vibration source distal from the massage end allows for shaping the massage end as desired. With no bulky vibration source near the massage end, the massage end can be shaped to complement various body orifices or surfaces without being limited by the size of the electronics or a vibration source.

The massager 10 just described can be dimensioned to be used on the exterior of the body. However, the dimension may also be fashioned to be inserted into the body. There are certain ergonomic dimensions that may be preferable to the shape of the massager 10. The massager 10 has to be large enough overall for it to feel satisfying, both during massage and, in particular, when used to provide sexual stimulation by insertion into the vagina, etc. It is also important, however, to make the massager 10 not so large as to feel inappropriate to most users. Further, the length of the midsection 16 preferably meets two criteria: that it is long enough so that the second end 14 can extend about 2-3 inches into the vagina, particularly along the anterior side thereof in order to reach the "g-spot" while being easily held by the first end 12; and, that it is short enough to be approachable (i.e., not daunting, overwhelming, or embarrassing) in appearance for a majority of users. Additionally, it is preferred that the midsection 16 form a relatively narrow "waist" between the first end 12 and the second end 14 to create a varying diameter along the longitudinal axis of the massager 10 so as to provide additional stimulation to the entrance of the vagina (or anus) as it stretches and relaxes the tissues during insertion and withdrawal therefrom. Preferably, the midsection 16 tapers from a waist that is, at the most narrow point, at least about 7.5% more narrow than the second end 14, and more preferably at least about 10% more narrow than the second end 14. The relative widths used to calculate the percentage decrease from the second end 14 to the most narrow point of the midsection 16 can be taken along the cross-sectional width, length, or both width and length of the second end 14 and the midsection 16. Preferably, such tapering occurs smoothly over a length that is not so long as to reduce the perceptibility of the change by the user, such as over a length of 60 mm or less. Alternatively the tapering can occur over a short distance in the form of a step or the like. Other possible arrangements for the surface of both the second end 14 and the midsection 16 can be used to provide similar stimulation, such as the use of ribs, bumps, various textures, multiple or repeating sections of tapering or widening, etc.

Figure 6:
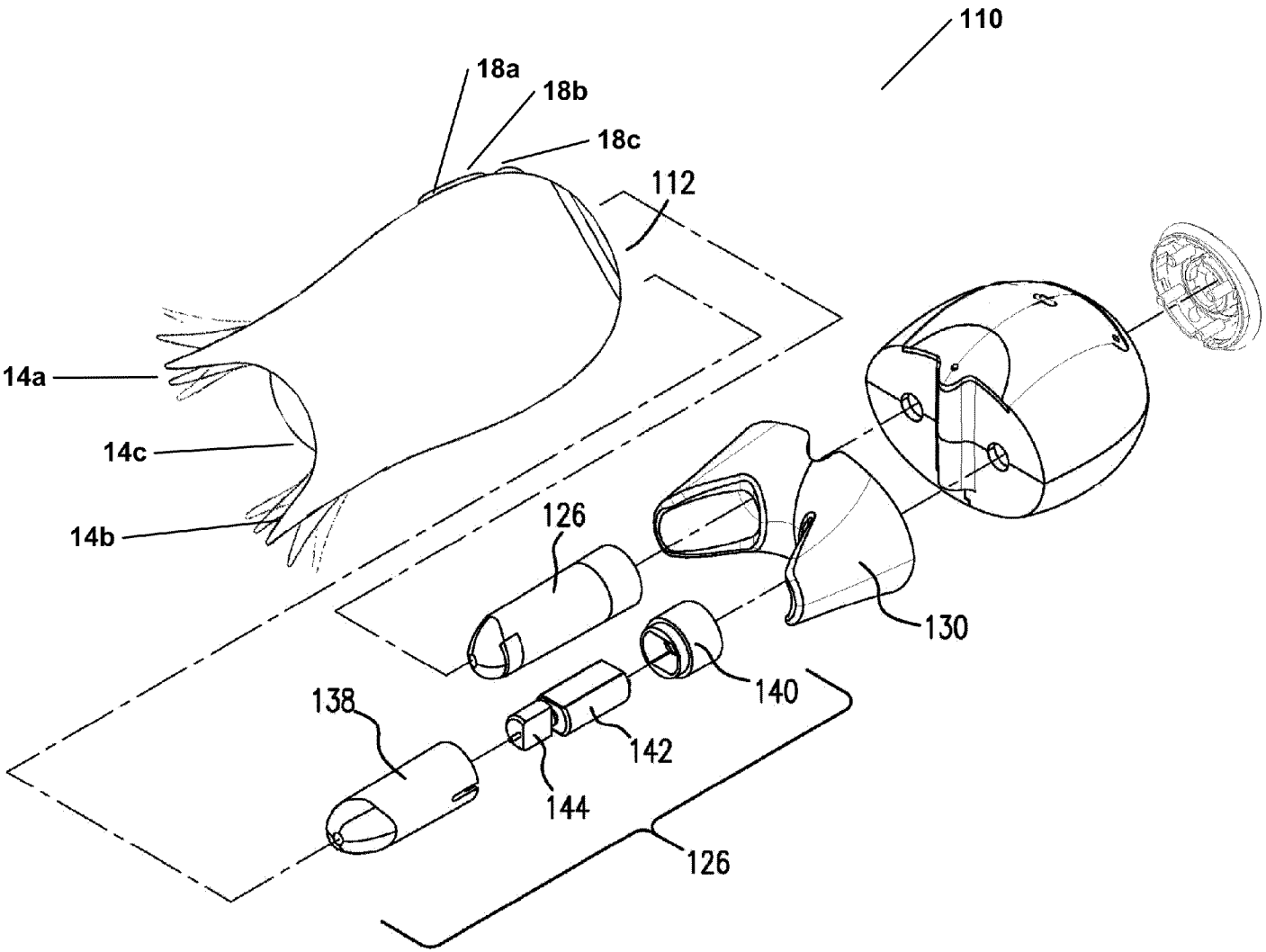
FIG. 6 is an exploded view of a second embodiment of the present invention.
Figure 7:
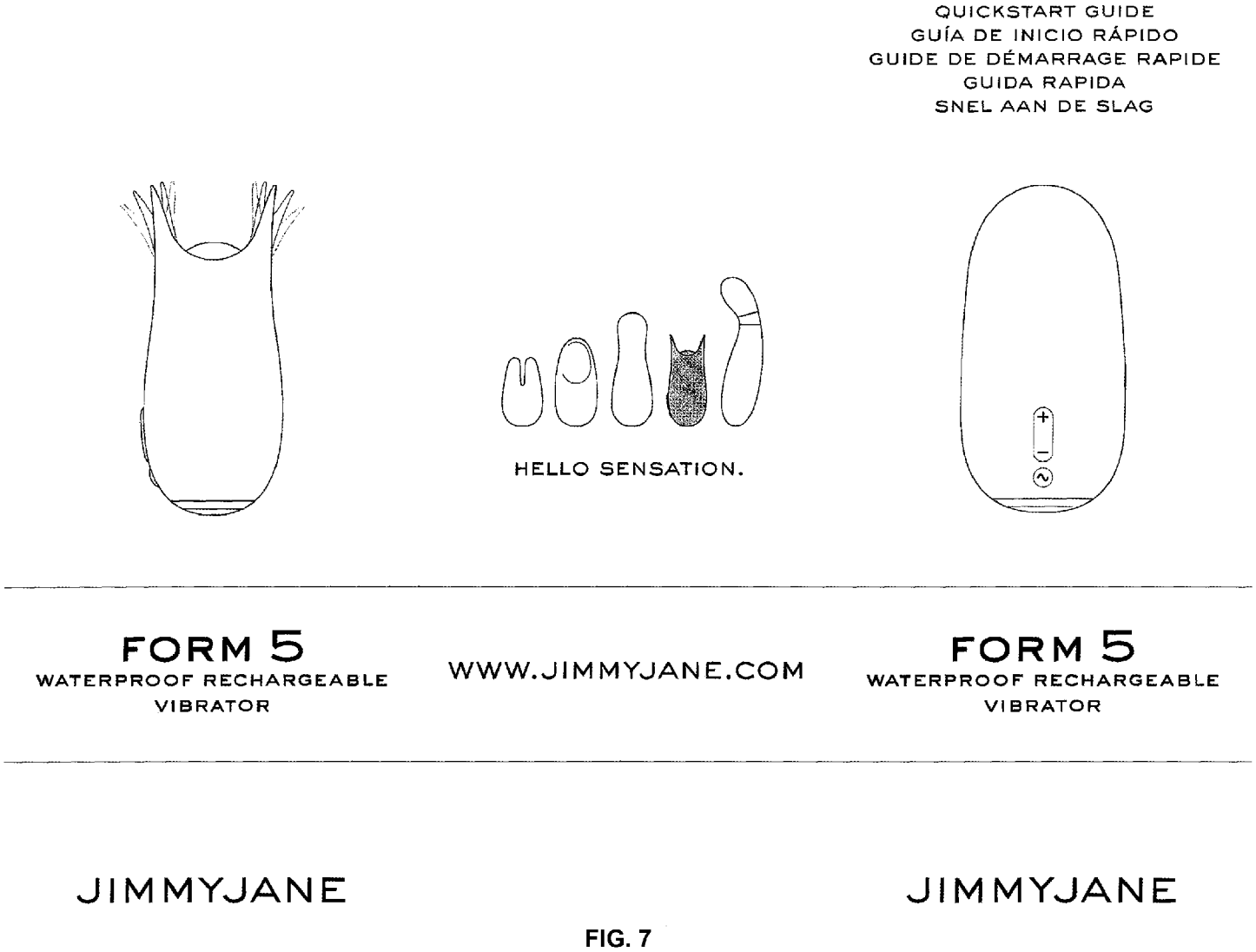

Turning to the embodiment of the massager 110 shown in FIG. 6, a variation of the massager includes a dual vibrating mechanism 126 that is housed by a flexible substructure 130, bringing the vibration closer to the wings 14*a* and 14*b* and the dome 14*c*. The massager 110 includes two motor units 126, each including a motor housing 138, an end cap 140, an electronic motor 142 and an offset weight 144. The functions of the motor units 126 is substantially the same as discussed above with respect to FIGS. 1-3B. Each of the motor units is positioned within a respective projection 134 to provide individual vibration thereto. The motors can be controlled by the PCB 31 that is held within the control housing 128 (as discussed above with respect to FIGS. 1-3B). Further, in a preferred embodiment, the motors 142 can be made to vibrate at different speeds, providing a different sensation between the projections 134 when used separately, or providing overlapping "beats" when used together. Examples of such operation and the control thereof is discussed further in the '825 Application. In this embodiment, it is preferable that the flexible substructure be flexible enough, through material selection and structure, that each of the individual motor units 126 can vibrate the wings 14*a* and 14*b* at the selected frequencies without being adversely affected by the operation of the other motor. In the present embodiment of the massager 110, it may also be beneficial to incorporate the use of alternative or additional sources of vibrational motion such as piezoelectric devices, solenoids, memory alloy, or the like, within the projections 134 to provide vibration, in the embodiments depicted, the projections 134 are shown having a substantially smooth surface. If desired, other implementations of the projections are contemplated, such as having a textured surface or the like. Other functional aspects and structures of the massager 110, including the use and interaction with a charging base (such as the base 90 shown in FIGS. 4 and 5), are preferably substantially similar those discussed above with respect to the embodiments of FIGS. 1-5.

The system is intended such that the base 90 is adaptable to receive mating ends of various devices having different structures than those shown. Additional structures can be designed and added to new products. If desired, contactless or wireless charging devices, such as inductive chargers, may be used. The charging end may, if desired, be substantially smooth and may include a soft overlying layer where the charging contacts are otherwise shown as exposed.

If desired, the massager device may be adapted to use a remote control. Examples of such incorporation are disclosed in the '825 Application as well as in U.S. patent application Ser. No. 11/344,987 to Imboden, et al., Ser. No. 11/245,456 to Imboden, et al.; and Ser. No. 11/345,455 to Imboden, et al., the entire disclosures of which are incorporated herein.

If desired, the massager device may further be implemented in an embodiment that uses standard (i.e., non-rechargeable) batteries. In such an embodiment, the charging contact cap 20 could, for example, be replaced by a cap over a cavity for receiving a battery or a plurality of batteries. Further embodiments are contemplated in which the entire device or portions of it, such as the second end of the massager, are not covered by a soft elastomer, but rather, for example, structures in which the working surface is constructed from plastic. Additionally, many aspects of the invention discussed above can be incorporated into other structures that are currently or may later be used for massage devices and/or to provide sexual stimulation. Additionally, the charger can be self-aligning and can be curved so as to be adapted to receive the massager.

The technology described herein may be applicable to other areas as well. The invention has been described in connection with specific embodiments that illustrate examples of the invention but do not limit its scope. Various example systems have been shown and described having various example aspects and elements. Unless indicated otherwise, any feature, aspect or element of any of these systems may be removed from, added to, combined with or modified by any other feature, aspect or element of any of the systems. As will be apparent to persons skilled in the art, modifications and adaptations to the above-described systems and methods can be made without departing from the spirit and scope of the invention, which is defined only by the following claims.

The invention claimed is:

1. A massager capable of simultaneously applying to an area of a user's body vibrations of different strengths and movements, comprising:

a body that extends longitudinally from a first end to a second end;

an electrically-powered vibrating element in vibratory communication with the second end;

the second end comprising two opposing and spaced-apart flexibly-compliant wings non-rigidly attached with and extending longitudinally away from the body, each of the wings comprising a base connected to the body and a distal end, the base having a cross-section with a first dimension and a second dimension orthogonal to the first dimension, and the first and second dimension tapering to the distal end, wherein the distal end is adapted to flutter by amplifying the movement of the electrically-powered vibrating element; and the second end further comprising a central end portion located between the wings and adapted to vibrate with the movement of the electrically-powered vibrating element without amplifying the movement of the electrically-powered vibrating element.

2. The massager of claim 1, further comprising:

the second end having a smooth outer surface adapted to comfortably contact and move across the user's body.

3. The massager of claim 1, further comprising:

a stretchable member adapted to be attached with the body by being stretched over at least a portion of the body including the wings.

4. The massager of claim 1, further comprising:

the body containing a motor unit and a control housing connected with a flexible substructure.

5. The massager of claim 4, further comprising:

the control housing comprises a printed circuit board that includes buttons adapted to control the electrically-powered vibrating element.

6. The massager of claim 5, further comprising:

a flexible cover over the first end and the buttons that is adapted to deform and engage the buttons when a user pushes on corresponding locations on the flexible cover.

7. The massager of claim 1, further comprising:

the first end sized and shaped for a user to grasp during use of the massager, with a substantially smooth and substantially continuous rounded outer surface.

8. The massager of claim 7, further comprising:

the first end comprising controls and charging contacts, and the substantially smooth and substantially continuous rounded outer surface is smooth and continuous with the exception of the controls and the charging contacts.

9. The massager of claim 1, wherein the massager is adapted to be completely submersed in water without being damaged.

10. The massager of claim 9, further comprising:

a selectively permeable membrane in the outer surface of the body adapted to allow communication of air but not water therethrough.

11. The massager of claim 1, further comprising:

a flexible midsection between the first end and the second end.

12. The massager of claim 1, further comprising:

the body varies in cross-sectional size as it extends longitudinally from the first end to the second end.

13. The massager of claim 1, further comprising:

a charging base adapted to hold the massager in a vertically upright position and charge the massager when the massager is placed in the charging base so that only the first end of the massager touches the charging base.

14. The massager of claim 13, wherein an outer surface of the first end of the massager comprises compliant silicone or thermoplastic elastomer, and a portion of the charging base that contacts the first end of the massager comprises polished polycarbonate or acrylonitrile butadiene styrene.

15. The massager of claim 1, further comprising:

two electrically-powered vibrating elements in vibratory communication with the second end, a first one of said electrically-powered vibrating elements located proximate a first one of said wings, and a second one of said electrically-powered vibrating elements located proximate a second one of said wings.

16. The massager of claim 1, further comprising:

the central end portion comprising a convex domed surface.

17. The massager of claim 16, further comprising:

the central end portion in substantially rigid connection with the electrically-powered vibrating element.

18. The massager of claim 1, further comprising:

the second end portion comprising a concave curved surface.

19. A massager comprising:

a body that extends longitudinally from a first end to a second end;

a vibrating element for causing the second end to vibrate;

the second end comprising two wings for amplifying the vibration of the vibrating element, each wing having a longitudinal axis and both longitudinal axes defining a plane; and the second end further comprising between the wings a central dome that intersects the plane.

* * * * *